US010108105B2

(12) United States Patent
Motohashi et al.

(10) Patent No.: US 10,108,105 B2
(45) Date of Patent: Oct. 23, 2018

(54) DEVELOPING APPARATUS AND IMAGE FORMING APPARATUS

(71) Applicant: CANON KABUSHIKI KAISHA, Tokyo (JP)

(72) Inventors: Satoru Motohashi, Kashiwa (JP); Yosuke Watanabe, Yokohama (JP); Masanori Tanaka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/481,364

(22) Filed: Apr. 6, 2017

(65) Prior Publication Data

US 2017/0299978 A1 Oct. 19, 2017

(30) Foreign Application Priority Data

Apr. 13, 2016 (JP) ..... 2016-080140
Apr. 13, 2016 (JP) ..... 2016-080518

(51) Int. Cl.
*G03G 15/08* (2006.01)

(52) U.S. Cl.
CPC ..... *G03G 15/0812* (2013.01); *G03G 15/0889* (2013.01); *G03G 15/0891* (2013.01)

(58) Field of Classification Search
CPC ..... G03G 15/081; G03G 15/0812; G03G 15/0822; G03G 15/0824; G03G 15/0874; G03G 15/0887; G03G 15/0889; G03G 15/0891; G03G 2215/0802; G03G 2215/0844; G03G 2215/085
See application file for complete search history.

(56) References Cited

U.S. PATENT DOCUMENTS

2009/0169269 A1* 7/2009 Okamoto ..... G03G 15/09 399/273
2015/0117879 A1* 4/2015 Fujii ..... G03G 15/0822 399/27
2017/0285523 A1* 10/2017 Itabashi ..... G03G 15/0889

FOREIGN PATENT DOCUMENTS

| | | | |
|---|---|---|---|
| JP | 4-31880 | A | 2/1992 |
| JP | 6-43745 | A | 2/1994 |
| JP | 6-130792 | A | 5/1994 |
| JP | 8-44206 | A | 2/1996 |
| JP | 2000-305345 | A | 11/2000 |
| JP | 2001-75344 | A | 3/2001 |
| JP | 2011-22516 | A | 2/2011 |
| JP | 2013-29543 | A | 2/2013 |

OTHER PUBLICATIONS

Machine translation of JP 06-130792 (publication date of May 13, 1994) printed on Jan. 12, 2018.*

* cited by examiner

*Primary Examiner* — Sophia S Chen
(74) *Attorney, Agent, or Firm* — Canon U.S.A., Inc. IP Division

(57) ABSTRACT

A toner circulation and a toner reservoir are formed in the vicinity of a developing roller. A member to form a toner reservoir is movable and is stopped during at least an image-forming period.

27 Claims, 32 Drawing Sheets

DEVELOPING APPARATUS AND IMAGE FORMING APPARATUS

BACKGROUND OF THE INVENTION

Field of the Invention

The present disclosure relates to image forming apparatuses, such as an electrophotographic printer and an electrophotographic copying machine.

Description of the Related Art

Image forming methods used in image forming apparatuses such as a copier, regularly include an electrophotographic recording method. In such a method, a front surface of a photosensitive drum, which is an image carrying member, is uniformly charged with a charging device, an electrostatic latent image is formed with an exposing device, and the electrostatic latent image is visualized into a toner image using toner, which is a developer, with a developing apparatus. Subsequently, the toner image is transferred to a recording material, such as paper, with a transfer device, such as an intermediate transfer body, and, ultimately, is fixed with a fixing device. Meanwhile, the remaining toner that had not been transferred to the transfer material from the photosensitive drum is collected by a cleaning device abutted against the photosensitive drum.

Regarding the developing apparatus, Japanese Patent Laid-Open No. 6-43745 discloses an apparatus that employs a method in which a non-magnetic mono-component toner accommodated inside a developer container is supplied to a developing roller, which is a developer carrying member, with a supply roller, in which the thickness of the toner on the developing roller is made substantially uniform with a developing blade, which is a developer regulating member, and in which an electrostatic latent image is developed.

Furthermore, Japanese Patent Laid-Open No. 8-44206 proposes a developing apparatus that, while configured to use a non-magnetic single-component toner, does not use a supply roller. The above configuration includes a supply guide that abuts against a developing roller. The toner is conveyed and accumulated in a space formed between the developing roller and the supply guide, and the toner is supplied with a synergistic effect between the toner self-weight and the rotary force of the developing roller.

Moreover, regarding the developing roller, Japanese Patent Laid-Open No. 6-130792 proposes a developing roller employing a method in which portions that have different electric resistances or dielectric constants are exposed and mixed on a front surface thereof at a regular and fixed pattern pitch, and in which a number of micro electric fields are formed on the front surface thereof. By employing the above method, an appropriate amount of toner can be adhered to the electrostatic latent image on the photosensitive drum; accordingly, an image that has high image density and that has an excellent diagram reproducibility and gradation can be obtained.

Note that in the developing roller described above in which portions with different dielectric constants are provided on the front surface, there are cases in which the electric resistance of the dielectric unit dependent on the environment changes depending on the material of the dielectric unit such that the toner adhesion amount on the developing roller changes according to the environment in which the developing roller is used. In order to overcome such a problem, Japanese Patent Laid-Open No. 4-31880 discloses a technique in which a material having a smaller variation difference in the volume resistivity of the dielectric unit is used.

However, with the method using a supply roller, since, other than the developer carrying member (a developing roller), a mechanism for rotating the supply roller is needed and, furthermore, since there is a limit to the extent to which the supply roller can be miniaturized, it is difficult to achieve miniaturization and simplification of the overall developing apparatus.

On the other hand, with the method that does not use a supply roller, while the above problem is alleviated, it will be difficult to supply the developer to the developer carrying member in a stable manner.

In other words, when the pressure of the developer against the front surface of the developer carrying member is insufficient, cases in which the developer required to form an image not being sufficiently carried onto the developer carrying member occur.

On the other hand, if the pressure of the developer against the developer carrying member is too high, aggregated developer becomes easily formed in the vicinity of the developer carrying member. Since the aggregated developer hinders the developer from being supplied to the developer carrying member, there are cases in which the developer is not sufficiently carried onto the developer carrying member.

Furthermore, in the case of the apparatus configuration that does not use the supply roller, the electric resistances of the dielectric units on the front surface of the developing roller disadvantageously changes according to the environment in which the developing roller is used such that, disadvantageously, the toner coat amount on the developing roller changes according to the environment. It is considered to be one of the effective techniques to use a material that has, in the volume resistivity of the dielectric unit, a small variation difference in order to overcome the above problem.

However, the technique of suppressing the resistance variation of the dielectric through the material that is used limits the material that can be used. There are cases in which it is difficult to make the developing roller, which is capable of being mass manufactured inexpensively, to have a desired characteristic; accordingly, a limit is met in the application thereof when balancing with mass productivity.

SUMMARY OF THE INVENTION

The present disclosure has been made after a diligent study to overcome the above problem and provides a developing apparatus that, while being configured to supply developer to the developer carrying member in a simple manner, is capable of supplying the developer to a developer carrying member in a stable manner.

The present disclosure provides the following image forming apparatuses and the like.

A developing apparatus including developer, a developer container that accommodates the developer, a developer carrying member that is rotatably supported by the developer container, and that carries the developer, a conveying member that is provided inside the developer container, the conveying member including a shaft portion and a conveying portion connected to the shaft portion, and a restriction portion that restricts the developer carried on the developer carrying member, the restriction portion being disposed so as to oppose the developer carrying member among an area around the developer carrying member, an area where the front surface of the developer carrying member moves gravitationally upwards during an image-forming period. In the developing apparatus, the conveying member moves during at least a portion of a non-image-forming period, and stops and takes a stop position during at least a portion of the image-forming period, and, in the stop position, a straight line, drawn from a base end of the conveying portion that is an end portion on a shaft portion side towards a tip of the conveying portion, intersects a surface of the developer carrying member opposing the inside of the developer container at a portion upstream in a rotation direction of the developer carrying member with respect to the restriction portion.

An image forming apparatus, including the developing apparatus according to the above, and a control unit that performs control such that the conveying member is in the stop position.

A developing apparatus used in an image forming apparatus, including a frame body that accommodates developer, a developer carrying member rotatably disposed in an accommodating chamber of the developer, the developer carrying member carrying the developer, a first member that is disposed so as to abut against or be positioned close to a front surface of the developer carrying member at a portion above a rotating shaft of the developer carrying member, and a second member that is disposed so as to be positioned close to the front surface of the developer carrying member at a position upstream of the first member in a rotation direction of the developer carrying member and below the first member. In the developing apparatus, a distance in the rotation direction between a first position where the first member abuts against or is proximate to the front surface of the developer carrying member, and a second position where the second member is proximate to the front surface of the developer carrying member can be changed, and while the developing apparatus is performing an image forming operation, the distance is maintained.

A developing apparatus used in an image forming apparatus, including a flexible container that forms an accommodating chamber in which developer is accommodated, a movable member provided so as to be movable outside the container, wherein by moving, the position abutted against the container changes such that a shape of the container can be changed, a developer carrying member that is rotatably disposed in the developer chamber, and that carries the developer, and a restriction member that is disposed above a rotating shaft of the developer carrying member so as to abut against or be positioned close to a front surface of the developer carrying member. In the developing apparatus, the container is configured so as to be capable of changing a position of a proximity portion that approaches the front surface of the developer carrying member at a portion upstream with respect to the restriction member in a rotation direction of the developer carrying member and below the restriction member by deformation caused by a movement of the movable member, and a distance in the rotation direction between the proximity portion and a position where the restriction member abuts against or is proximate to the front surface of the developer carrying member is capable of being changed.

A developing apparatus used in an image forming apparatus, including a frame body that accommodates developer, a developer carrying member rotatably disposed in an accommodating chamber of the developer, the developer carrying member carrying the developer, a first restriction member that is disposed so as to abut against a front surface of the developer carrying member at a portion above a rotating shaft of the developer carrying member, and a second restriction member that, at a position upstream with respect to the first restriction member in a rotation direction of the developer carrying member and at a position below the first restriction member, includes a first end portion that approaches the front surface of the developer carrying member, and a second end portion that is away from the front surface. In the developing apparatus, when viewed in a direction in which the rotating shaft of the developer carrying member extends, a distance between a point of contact between the front surface and the first restriction member, and an intersection between an extended virtual line connecting the first end portion and the second end portion of the second restriction member and the front surface is capable of being changed, and the distance is maintained while the developing apparatus is performing an image forming operation.

An image forming apparatus that forms an image on a recording material, including an image carrying member, the developing apparatus developing a latent image formed on the image carrying member into a developer image that is transferred to a recording material, and at least a control unit that controls the developing apparatus.

Further features of the present disclosure will become apparent from the following description of exemplary embodiments with reference to the attached drawings.

DESCRIPTION OF THE EMBODIMENTS

First Exemplary Embodiment

Hereinafter, a configuration of the present exemplary embodiment will be exemplified with reference to the drawings. Note that the dimensions, the materials, and the shapes of the components, the relative arrangement of the components, and the like that are described in the present exemplary embodiment are to be appropriately altered based on the configuration of the device to which the present disclosure is applied and on various conditions, and the scope of the present disclosure is not intended to be limited by the following exemplary embodiments.

Image Forming Apparatus and Process Cartridge

Figure 1:
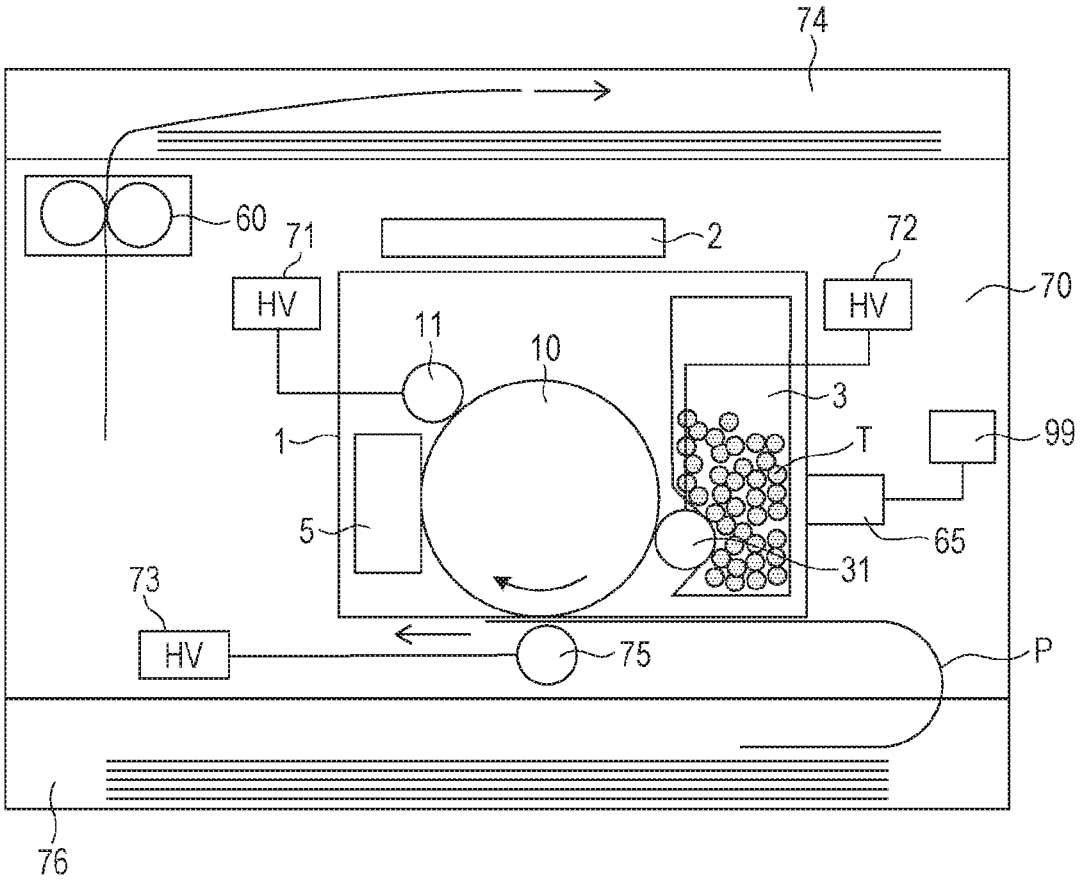
FIG. 1 is a diagram for describing an image forming apparatus according to a first exemplary embodiment.

Referring to FIG. 1, an electrophotographic image forming apparatus (an image forming apparatus), such as a copier or a printer, and a process cartridge that can be attached and detached to and from the above apparatus, which are adopted in a first exemplary embodiment, will be described.

FIG. 1 is a schematic cross-sectional view illustrating a configuration of the image forming apparatus according to the first exemplary embodiment. As illustrated in FIG. 1, the image forming apparatus according to the first exemplary embodiment includes a detachable process cartridge 1 inside an image forming main body 70.

The process cartridge 1 includes a photosensitive drum 10 serving as an image carrying member that carries an electrostatic latent image, a charging roller 11 serving as a charging member, a cleaning device 5, and a developing apparatus 3. The developing apparatus 3 includes a developing roller 31 serving as a developer carrying member, and accommodates developer (hereinafter, referred to as toner) T that is a negatively charged non-magnetic mono-component developer. The developing apparatus 3 is configured so that the developing roller 31 is capable of being abutted against and separated from the photosensitive drum 10.

A predetermined direct current voltage is applied to the charging roller 11 from a voltage applying member 71 for a charging device provided inside the image forming main body 70. Furthermore, the charging roller 11 uniformly charges a front surface of the photosensitive drum 10.

An exposing device 2 serving as an optical member emits a modulated laser beam based on image information sent from an information processing device (not shown) onto the front surface of the photosensitive drum 10. Subsequently, an electrostatic latent image is formed on the front surface of the photosensitive drum 10.

A voltage applying member 72 for the developing apparatus applies a predetermined direct current voltage to the developing roller 31 so as to turn the electrostatic latent image into a visible image with the developing apparatus 3. Furthermore, the developing roller 31 comes into contact with the photosensitive drum 10, and the toner T contained in the developing apparatus 3 is developed on the front surface of the photosensitive drum 10 such that a visible image (hereinafter, referred to as a toner image) is formed.

Synchronizing with the formation of the toner image, a recording material P serving as a recording medium is conveyed from the cassette 76 serving as a feeding unit. A predetermined voltage is applied to a transferring roller 75 serving as a transfer member with a voltage applying member 73 for the transfer device in order to transfer the toner image on the photosensitive drum 10 to the recording material P.

Most of the toner image is transferred to the recording material P; however, a portion remains on the photosensitive drum 10. The remaining toner T is collected by the cleaning device 5.

Furthermore, a fixing device 60 serving as a fixing unit fixes, with heat and pressure, the toner image transferred to the recording material P. The recording material P on which fixing has been completed is discharged onto a sheet discharge tray 74.

After the above, formation of images is continued through repetition of a similar process. In the description hereinafter, an "image-forming period" refers to a period when an electrostatic latent image formed on the front surface of the photosensitive drum 10 based on the image information reaches a position (a developing position) where the photosensitive drum 10 and the developing roller 31 are in contact with each other and when the developing apparatus 3 is turning the electrostatic latent image into a toner image. A "non-image-forming period" refers to a period when the developing apparatus 3 is not turning an electrostatic latent image into a toner image.

Developing Apparatus

Figure 2:
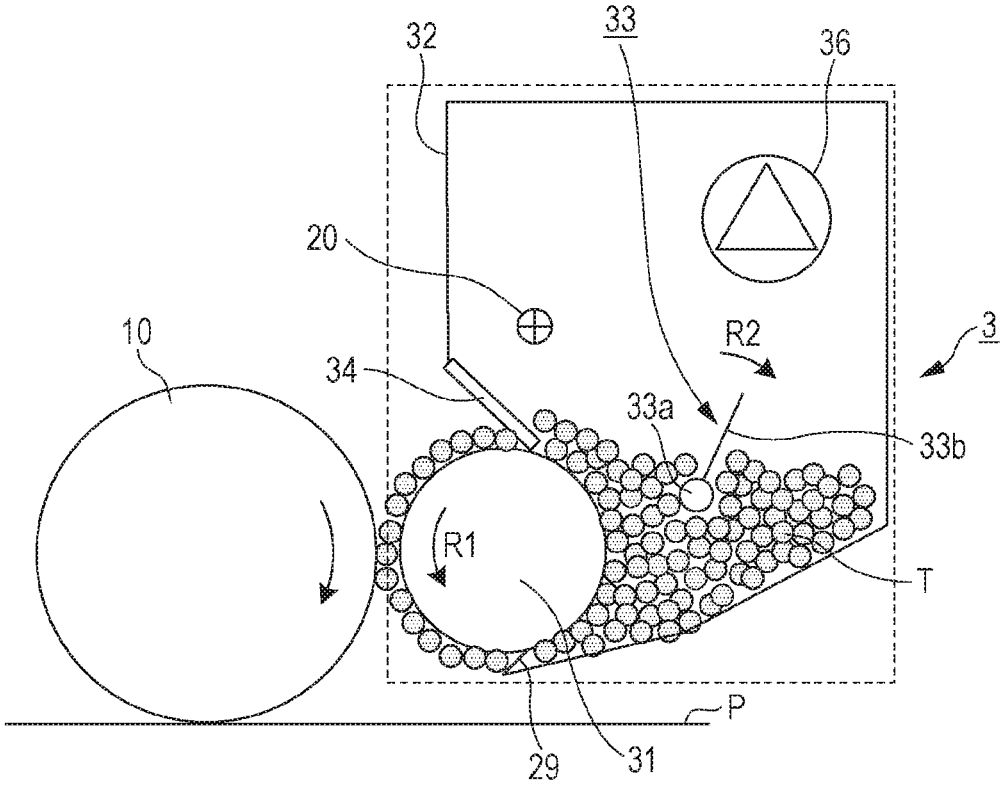
FIG. 2 is a diagram for describing a developing apparatus according to the first exemplary embodiment.

Referring to FIG. 2, a configuration of the developing apparatus 3 of the present exemplary embodiment will be described. FIG. 2 illustrates the developing apparatus 3 during the image-forming period.

The developing apparatus 3 includes the toner T, the developing roller 31, a developer container 32 that accommodates the toner T, a toner conveying member 33 serving as a conveying member, and a developing blade 34 serving as a developer regulating member.

The toner T has a non-magnetic negative chargeability, and a material such as, for example, a non-magnetic styrene-acryl-based+polyester-based resin is used.

The developing roller 31 carries the toner T on the surface thereof and is disposed in an opening at the lower portion of the developer container 32. The developing roller 31 is supported by the developer container 32 so as to be rotational in an R1-direction about a central axis (not shown) serving as a rotation center.

The toner conveying member 33 is included inside the developer container 32. The toner conveying member 33 includes a shaft portion 33*a*, and a conveying portion 33*b* that is connected to the shaft portion 33*a* and that conveys the toner T. The shaft portion 33*a* is formed of high impact polystyrene (HIPS) and the like. The conveying portion 33*b* is formed of a thin elastic body, such as a polyethylene terephthalate (PET) sheet having a thickness of about 50 to 200 μm. The toner conveying member 33 is rotatable in an arrow R2 direction, and rotates so as to convey the toner T positioned gravitationally below the center of the shaft portion 33*a* towards the vicinity of the developing roller 31.

The developing blade 34 is formed of a metal plate, such as a stainless steel (SUS) plate having a thickness of 50 to 120 μm. The developing blade 34 abuts against the developing roller 31 at a contact pressure of about 10 to 50 gf/cm so as to restrict the toner T on the developing roller 31 to a substantially uniform thickness.

An opening sealing sheet 29 is provided downstream of the developing blade 34 in the rotation direction R1. The opening sealing sheet 29 is in contact with the developing roller 31 and prevents the toner T inside the developer container 32 from leaking out.

Note that the surface of the developing 31 extending in the rotation direction R1 from the position, serving as a starting point, where the opening sealing sheet 29 abuts against the developing roller 31 to the position where the developing blade 34 abuts against the developing roller 31 is defined as a "surface of the developing roller 31 facing the inside of the developer container 32".

With the configuration described above, the developing apparatus 3 restricts the amount of toner T carried on the developing roller with the developing blade 34 and supplies the toner T to the photosensitive drum 10.

Figure 3:
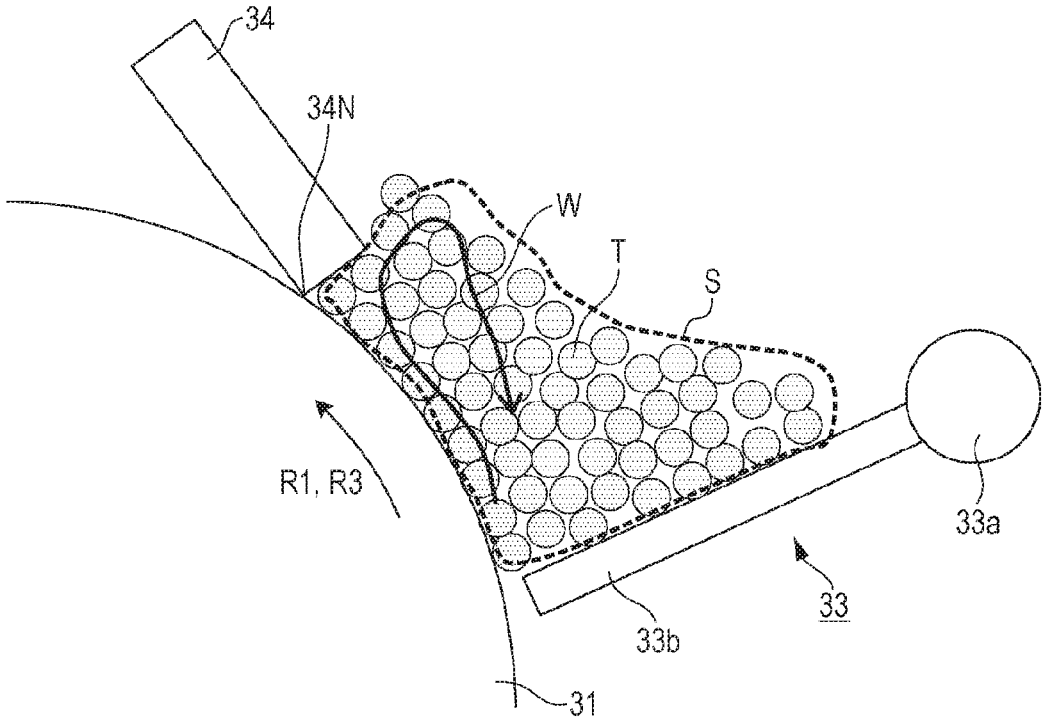
FIG. 3 is a diagram for describing toner carrying of the developing roller of the first exemplary embodiment.

Before the image formation, the developing roller 31 and the photosensitive drum 10 are separated from each other with a gap of about 100 μm. When an image forming signal is sent, the image forming apparatus drives a drive input unit 36 of the developing apparatus 3 with a drive source (not shown) and rotates the developing roller 31. Subsequently, the developing apparatus 3 is moved about a pivot center 20 with an abutment and separation drive unit 65 (see FIG. 1) such that the photosensitive drum 10 and the developing roller 31 abut against each other. Subsequently, the developing apparatus 3 performs formation of a toner image. In the present exemplary embodiment, the toner conveying member 33 is stopped while the developing roller 31 and the photosensitive drum 10 abut against each other. In other words, the toner conveying member 33 stops during at least a portion of the image-forming period. On the other hand, when the developing roller 31 and the photosensitive drum 10 are separated from each other, the toner conveying member 33 is rotated. The reason for employing such a mechanism will be described later. Toner carrying of developing roller Toner carrying of the developing roller 31 will be described with reference to FIGS. 3 and 4. FIG. 3 illustrates the developing roller 31, the toner T, the toner conveying member 33, and the developing blade 34 during the image-forming period. As illustrated in FIG. 3, in the present exemplary embodiment, the developing blade 34 abuts against the developing roller 31, and includes an abutting portion 34N serving as a restriction portion that restricts the toner T carried by the developing roller 31. The abutting portion 34N is disposed so as to oppose the developing roller 31, in an area among the area around the developing roller 31, the area where the front surface of the developing roller 31 moves gravitationally upwards during the image-forming period. Details of the function of the abutting portion 34N will be described later.

Toner carrying of the developing roller 31 is performed by creating a toner circulation W and a toner reservoir S illustrated in FIG. 3. With the force of the developing roller 31 rotating in the R1-direction, the toner T is conveyed and is moved up the front surface of the developing roller 31. Furthermore, a portion of the toner is restricted by the abutting portion 34N of the developing blade 34. The restricted toner T moves towards the lower side of the developer container 32. In other words, the toner T returns towards the upstream side in the rotation direction R1 of the developing roller 31. The toner circulation W is created in the above manner. The toner T moving upwards on the developing roller 31 is rolled on the developing roller 31 in an arrow R3 direction and is charged due to the rolling friction between the toner T restricted at the abutting portion 34N.

Figure 4:
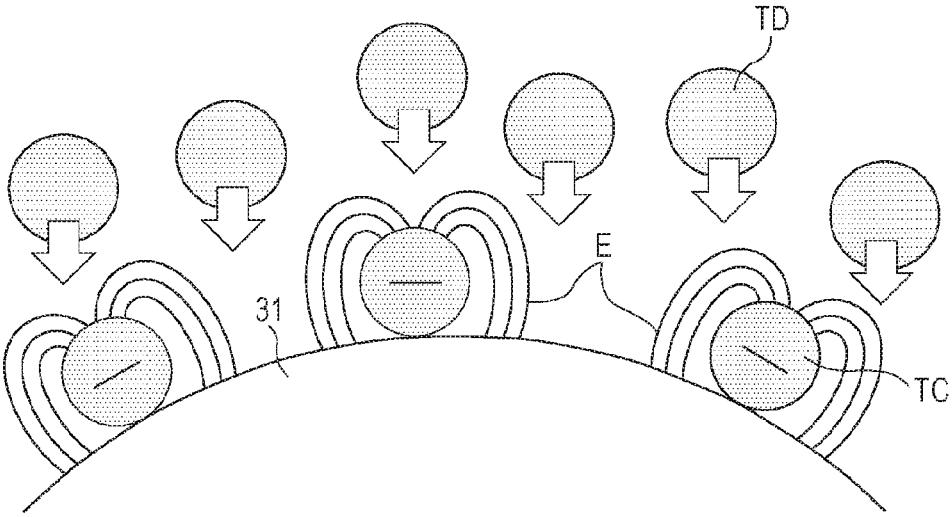
FIG. 4 is a diagram for describing toner carrying of the developing roller of the first exemplary embodiment.

As illustrated in FIG. 4, when the toner T on the developing roller 31 is charged, minute closed electric fields are generated between charged toner TC and the adjacent front surface of the developing roller 31; accordingly, a plurality of minute closed electric fields are formed in the entire developing roller 31. In the above, if a toner reservoir S is formed in the vicinity of the developing roller 31, non-charged toner TD in the toner reservoir S receives gradient force generated by the minute closed electric fields described above. The non-charged toner TD in the vicinity of the developing roller 31 is then drawn to and carried by the front surface of the developing roller 31.

Arrangement of Toner Conveying Member and Developing Blade

Referring to FIGS. 5 to 7B, the arrangement of the toner conveying member 33 and the developing blade 34 will be described in further detail.

Figure 5:
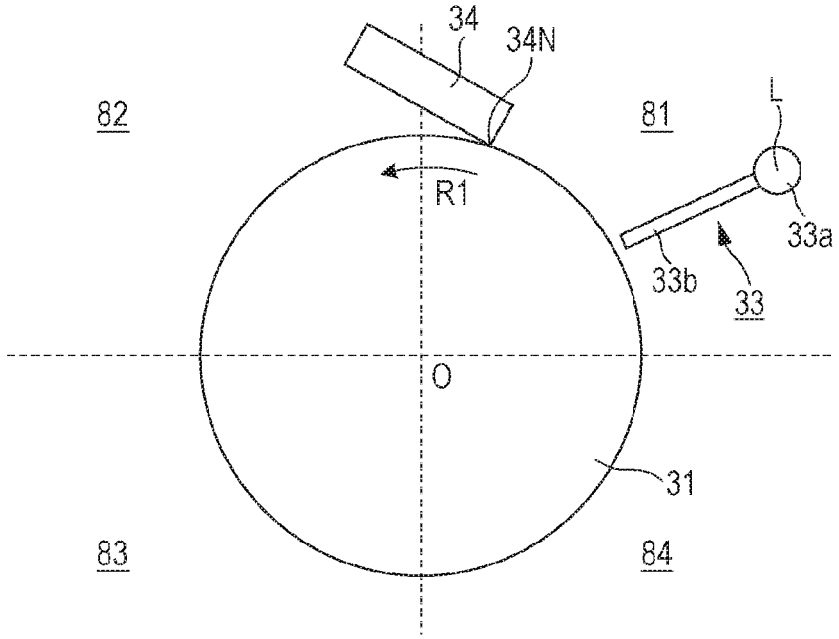
FIG. 5 is a diagram for describing an arrangement of the developing roller, a developing blade, and a toner conveying member of the first exemplary embodiment.

FIG. 5 illustrates the developing apparatus 3 during the image-forming period. As described above, during the image-forming period, the developing roller 31 is rotated and the toner conveying member 33 is at a stop. During the image-forming period, the position of the toner conveying member 33 when the toner conveying member 33 is at a stop is referred to as a stop position.

As illustrated in FIG. 5, the developing roller 31 is divided into four quadrants (81, 82, 83, 84) by drawing lines in the gravitational direction and the horizontal direction passing a rotation center O of the developing roller 31 serving as the origin. A center L of the shaft portion 33*a* of the toner conveying member 33 and the abutting portion 34N of the developing blade 34 are arranged, in the area among the area around the developing roller 31, the area where the front surface of the developing roller 31 moves gravitationally upwards during the image-forming period. Moreover, desirably, the center L of the shaft portion 33*a* of the toner conveying member 33 and the abutting portion 34N of the developing blade 34 are arranged in the area 81 (the first quadrant) that is an area positioned gravitationally above the line drawn in the horizontal direction passing through the rotation center O of the developing roller 31. Each member is arranged in the above position so as to effectively manifest the toner charge on the developing roller 31 with the toner circulation W and the toner reservoir S described above. The above will be described in detail using FIG. 6.

Figure 6:
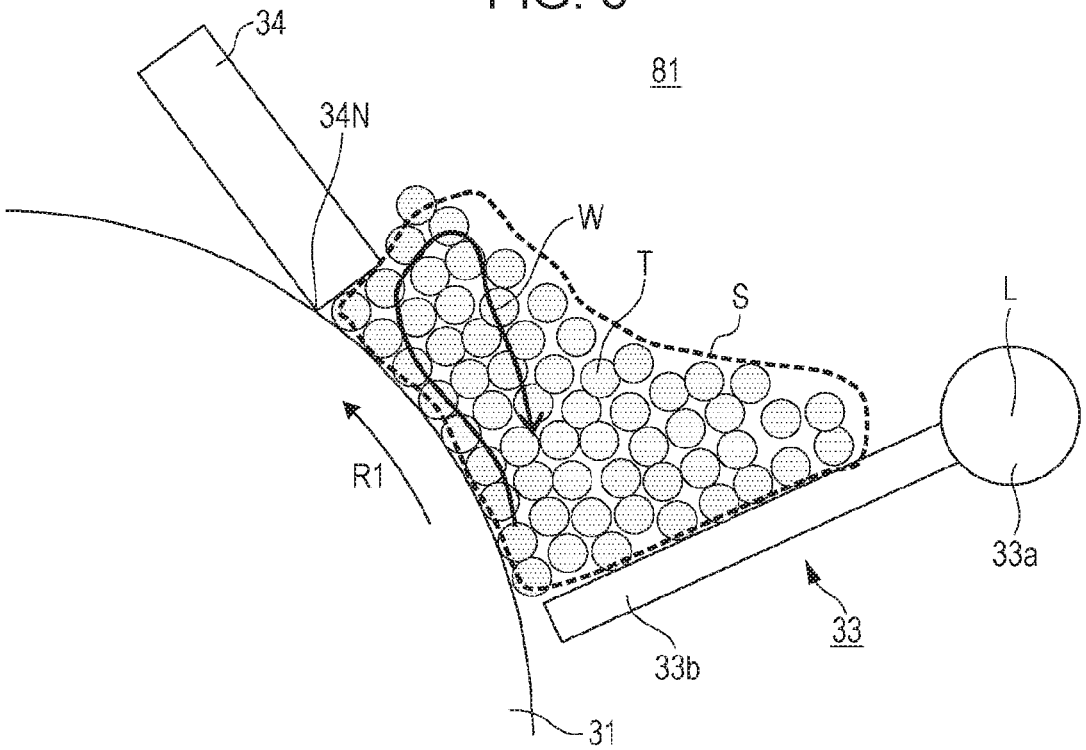
FIG. 6 is a diagram for describing an arrangement of the developing roller, the developing blade, and the toner conveying member of the first exemplary embodiment.

FIG. 6 is an enlarged view of an area 81 in FIG. 5. The abutting portion 34N restricts the flow of the toner T moving up in the rotation direction R1 of the developing roller 31, and the restricted toner T flows downwards due to its own weight. In other words, the restricted toner T returns downwards towards the upstream side in the rotation direction R1 of the developing roller 31 by its own weight and forms a desirable toner circulation W described above.

Furthermore, by stopping the toner conveying member 33 at a predetermined position, the toner reservoir S is formed in the space formed by the developing roller 31 and the toner conveying member 33. Accordingly, the toner accumulated in the toner reservoir S can be carried by the developing roller 31.

In the above state, by arranging the center L of the shaft portion 33*a* of the toner conveying member 33 in the area 81, the toner conveying member 33 will be in a position to form the toner reservoir S more easily. Furthermore, desirably, the center L of the shaft portion 33*a* of the toner conveying member 33 is arranged gravitationally below the abutting portion 34N. By so doing, the toner reservoir S can be formed in a smaller space.

Figure 7A:
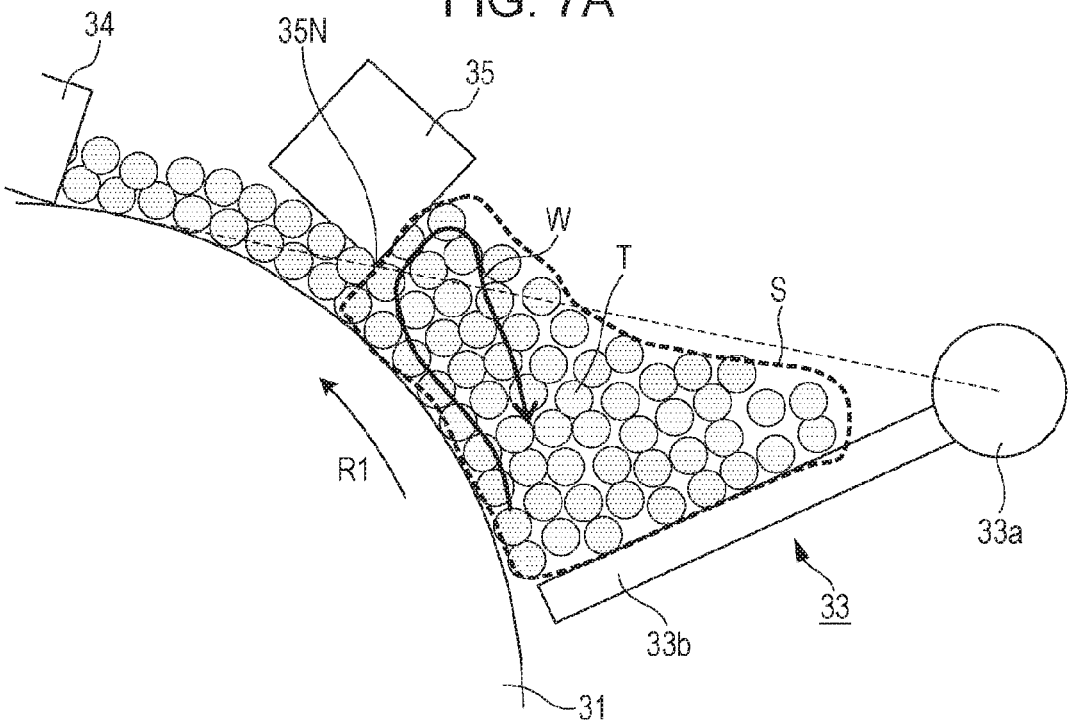
FIGS. 7A and 7*b* are diagrams for describing an arrangement of the developing roller, a restriction portion, and the toner conveying member of the first exemplary embodiment.
Figure 7B:
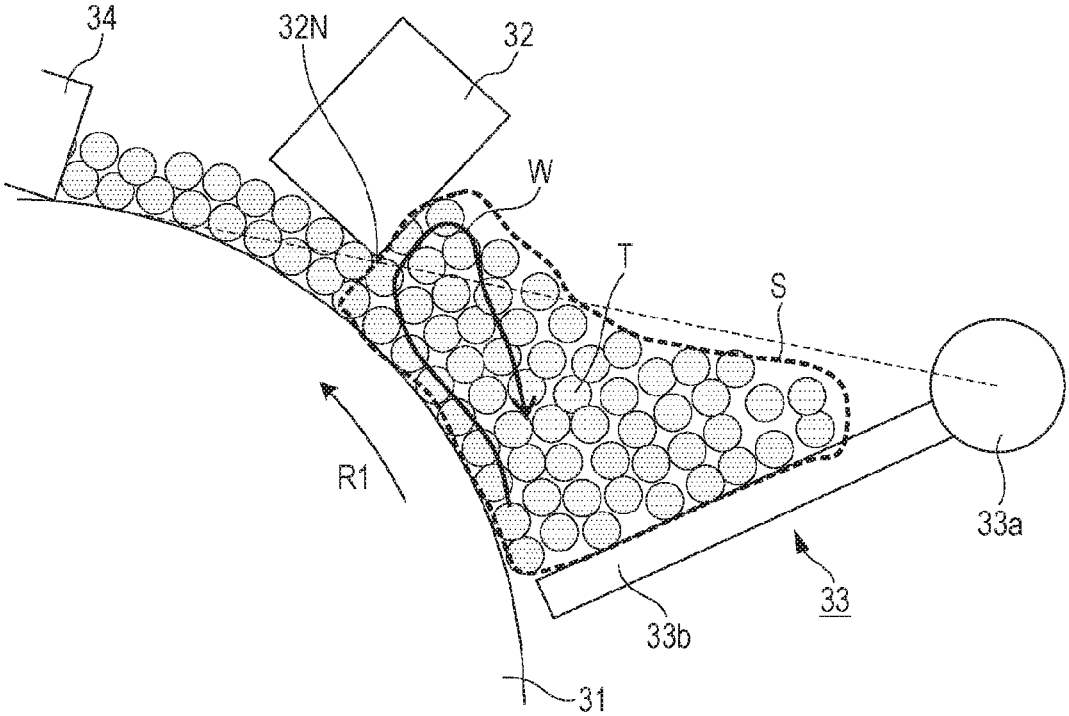

Note that in the present exemplary embodiment, while an example using the abutting portion 34N of the developing blade 34 as the restriction portion to form a desirable toner circulation W has been given, other configuration may be adopted. For example, as illustrated in FIG. 7A, a toner restriction member 35 serving as a restriction portion may be disposed. Furthermore, as illustrated in FIG. 7B, a portion of the developer container 32, serving as the restriction portion, may be disposed at the position where the toner restriction member 35 above is disposed. In such a case, a proximity portion (35N or 32N) on the upstream side in the rotation direction R1 of the developing roller 31 functions as the restriction portion. Note that in such a case, the developing blade 34 is disposed, in the rotation direction R1 of the developing roller 31, downstream of the toner restriction member 35 and the portion of the developer container 32 having a function of the restriction portion.

Operation of Toner Conveying Member

An operation of the toner conveying member will be described with reference to FIGS. 8A to 10B.

The toner conveying member 33 interlocks with the abutting and separating operation of the developing roller 31 and the photosensitive drum 10, stops during at least a portion of the image-forming period, and rotates during at least a portion of the non-image-forming period.

Note that as it has been described above, the "image-forming period" refers to a period when an electrostatic latent image formed on the front surface of the photosensitive drum 10 based on the image information reaches a position (a developing position) where the photosensitive drum 10 and the developing roller 31 are in contact with each other and when the developing apparatus 3 is turning the electrostatic latent image into a toner image. The "non-image-forming period" refers to a period when the developing apparatus 3 is not turning an electrostatic latent image into a visible image.

The reason for stopping the toner conveying member 33 at the above timing and the reason for operating the toner conveying member 33 will be described below.

Figure 8A:
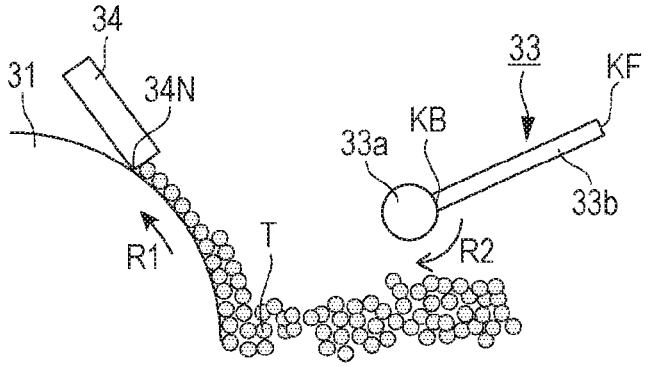
FIGS. 8A to 8C are diagrams for describing a rotation operation and a stop operation of the toner conveying member of the first exemplary embodiment.

First of all, the toner conveying member 33 is stopped during the image-forming period to carry the toner on the developing roller 31 in a stable manner. As described above, in order to carry the toner in a stable manner, the toner circulation W and the toner reservoir S needs to be formed (see FIG. 6). If the toner conveying member 33 were to be operated during the image-forming period, as illustrated in FIG. 8A, no toner circulation W nor the toner reservoir S will be formed when a tip KF of the toner conveying member 33 is at a position away from the developing roller 31. Accordingly, the conveying portion 33*b* of the toner conveying member 33 is stopped in the vicinity of the developing roller 31 during image formation such that the toner reservoir S is formed.

Figure 8B:
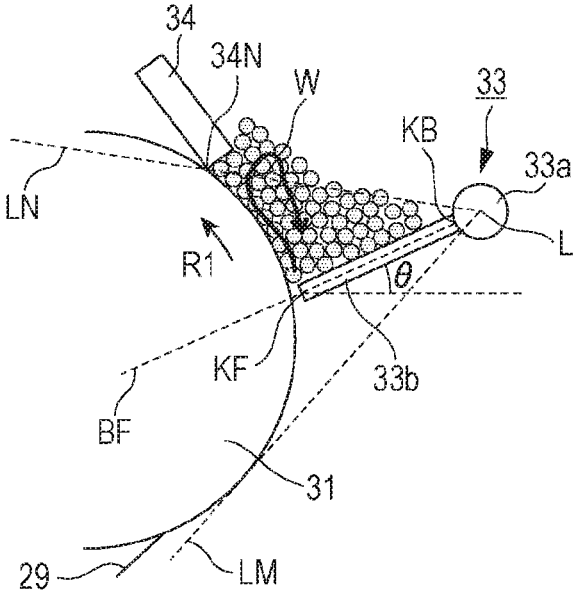

FIG. 8B illustrates the stop position of the toner conveying member 33. In the stop position, the tip KF of the toner conveying member 33 is closer to the center of the developing roller 31 than a base end KB that is an end portion on the shaft portion side. Furthermore, the toner T on the toner conveying member 33 forms the toner reservoir S, and is in contact with the developing roller 31. Meanwhile, the developing roller 31 is rotated such that the toner restricted with the abutting portion 34N forms the toner circulation W.

While the toner conveying member 33 is in the stop position, the toner T is carried on the developing roller 31 with the toner circulation W and the toner reservoir S described above. Accordingly, the amount (a carrying amount) of toner carried by the developing roller 31 when the toner conveying member 33 is in the stop position is larger than when the toner conveying member 33 is in a position other than the stop position (in particular, at a position where no toner reservoir S is formed). In other words, the toner conveying member 33 in the stop position forming the toner reservoir S in the vicinity of the developing roller applies an appropriate toner pressure to the developing roller 31 so that the amount of toner T carried by the developing roller 31 can be increased.

Confirmation of whether the toner conveying member 33 in the stop position has increased the carrying amount of toner T on the developing roller 31 can be performed by measuring the carrying amount of toner T carried by the developing roller 31. Note that the stop position of the toner conveying member 33 may be a position that enables the carrying amount required for forming the image is obtained and a position in which the carrying amount is the largest does not have to be selected.

Furthermore, among other methods, another method to make a confirmation is to rotate and stop the toner conveying member 33 while directly observing the state of the above. In other words, it is only sufficient that the toner reservoir S is in contact with the developing roller 31 when the toner conveying member 33 is at a stop.

Moreover, a further easier method is to actually form images and check whether there are any defective images caused by insufficient toner carrying of the developing roller 31.

Note that the confirmation above includes confirmation that is performed using the amount of toner that is near the end of its life time, which is assumed during use of the developing apparatus 3.

The stop position of the toner conveying member 33 is, desirably, a position where the toner conveying member 33 is close to the developing roller 31.

When assuming that a straight line BF is drawn, as illustrated in FIG. 8B, from the base end KB of the conveying portion 33*b* to the tip KF while the toner conveying member 33 is in the stop position, it is desirable that the straight line BF intersects, on the upstream side of abutting portion 34N in the rotation direction R1 of the developing roller 31, the surface of the developing roller 31 facing the inside of the developer container 32.

Furthermore, as illustrated in FIG. 8B, assume that a straight line LN from the center L of the shaft portion 33*a* of the toner conveying member 33 to the end portion of the abutting portion 34N of the developing blade 34 on the upstream side in the rotation direction of the developing roller 31 is drawn. Moreover, among the tangential lines drawn from the center L of the shaft portion 33*a* of the toner conveying member 33 to the front surface of the developing roller 31, a tangential line LM extending gravitationally downwards is drawn. In so doing, the tip KF of the conveying portion 33*b* in the stop position may be positioned between the straight line LN and the tangential line LM. The desirable toner circulation W and toner reservoir S can be formed in the above manner. Note that in a case of the configuration illustrated in FIG. 7A or 7B, the straight line LN described above may be a straight line drawn so as to pass the proximity portion (35N or 32N) on the upstream side in the rotation direction.

Figure 8C:
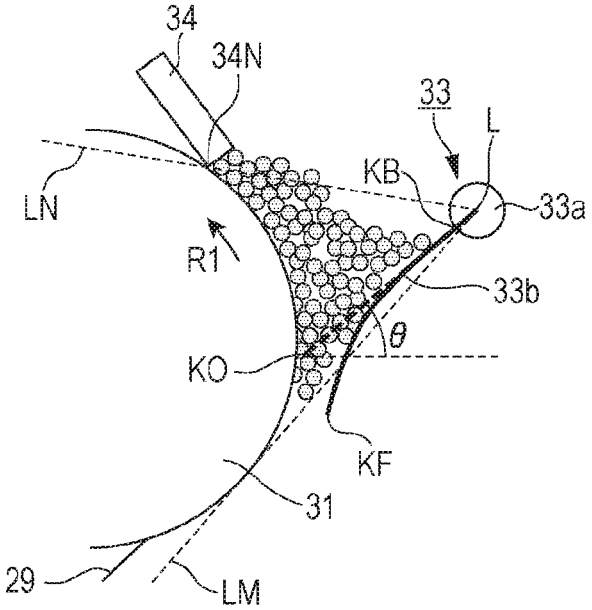

Furthermore, as illustrated in FIG. 8C, in a case in which the conveying portion 33*b* of the toner conveying member 33 is flexible, there are cases in which the conveying portion 33*b* is bend downwards. In such a case, by having a tip K0, which is a tip when assuming that the conveying portion 33*b* is not bent, be positioned between the straight line LN and the tangential line LM described above, a similar effect can be expected.

Figure 9A:
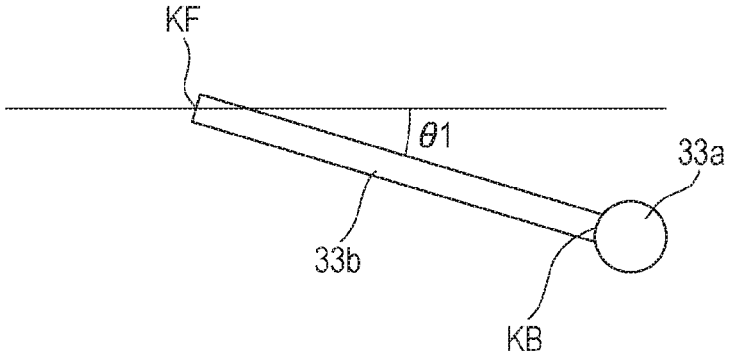
FIGS. 9A to 9C are diagrams for describing a stop position of the toner conveying member of the first exemplary embodiment.
Figure 9B:
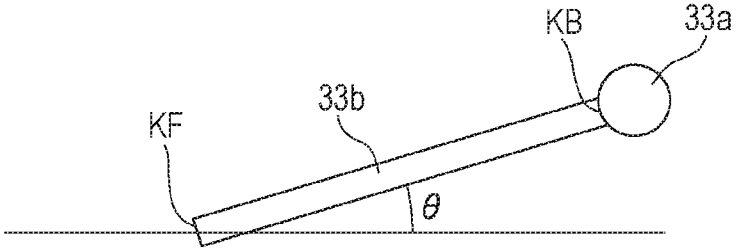
Figure 9C:
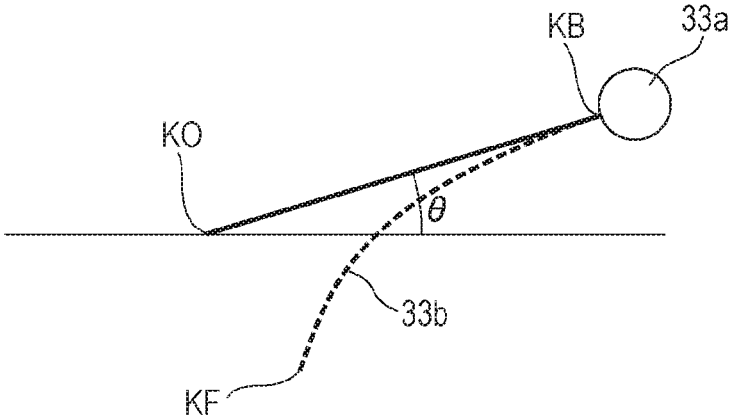

Referring now to FIGS. 9A to 9C, the stop position of the toner conveying member will be described further.

While the toner conveying member 33 is in the stop position, in a case in which the straight line drawn from the tip KF towards the base end KB extends gravitationally downwards (in a case in which the tip KF is oriented gravitationally upwards), when the inclination is large, the toner T disadvantageously falls in a direction away from the developing roller 31. Accordingly, in such a case, it is better that an angle θ1 formed between the straight line drawn from the tip KF towards the base end KB and the horizontal line is small, and it is desirable that the angle θ1 be smaller than the angle of repose of the toner T (FIG. 9A).

Furthermore, while the toner conveying member 33 is in the stop position, in a case in which the straight line drawn from the tip KF towards the base end KB extends gravitationally upwards (in a case in which the tip KF is oriented gravitationally downwards), it is desirable that the inclination be large. Furthermore, it is preferable that the angle θ formed between the straight line drawn from the tip KF towards the base end KB and the horizontal line be larger than the angle of repose of the toner T itself (FIG. 9B). By so doing, the toner T on the conveying portion 33*b* of the toner conveying member 33 is more easily accumulated in the toner reservoir S formed on the developing roller 31 side; accordingly, the toner T can be used efficiently. Note that in a case in which the conveying portion 33*b* is flexible, if the angle θ formed between a straight line drawn from the tip K0, which is a tip when assuming that the conveying portion 33*b* is not bent, to the base end KB and the horizontal line satisfies the relationship described above, a similar effect can be expected (FIG. 9C).

Moreover, while the toner conveying member is in the stop position, it is desirable that the toner conveying member 33 and the developing roller 31 be distanced away from each other. The above is to prevent the developing roller 31 and the toner conveying member 33 from becoming worn due to rotation of the developing roller 31 alone while the developing roller 31 and the toner conveying member 33 are in contact with each other. Note that in order to form a satisfactory toner reservoir S, the gap between the toner conveying member 33 and the developing roller 31 in the stop position is, desirably, about 2 mm or under.

Next, the reason for rotating the toner conveying member 33 during the non-image-forming period will be described with reference to FIGS. 10A and 10B. The reason for the above is to reset the toner accumulated state in the toner reservoir S.

Figure 10A:
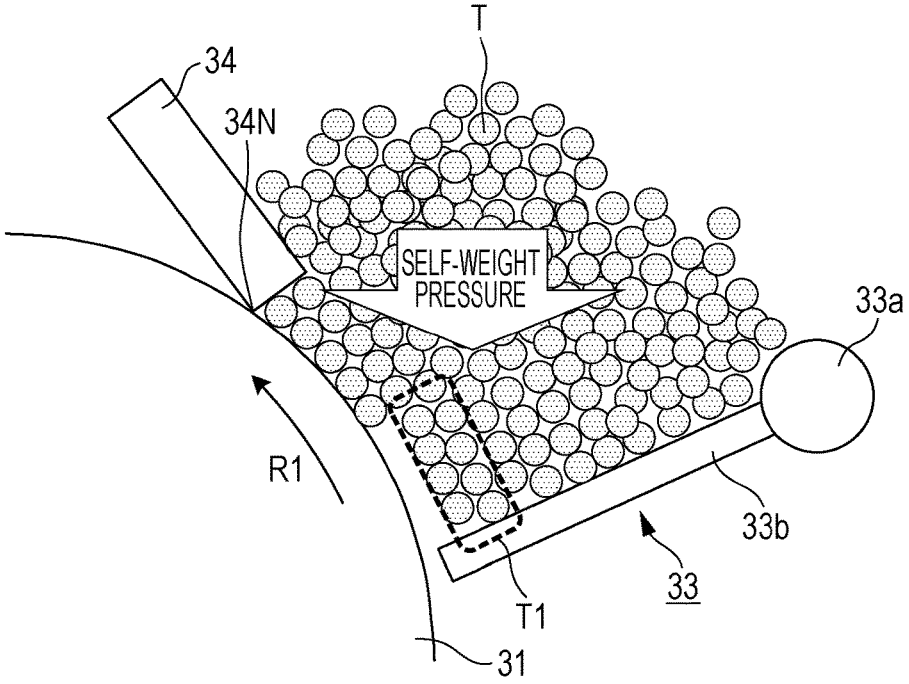
FIGS. 10A and 10B are diagrams for describing the reason for rotating the toner conveying member during a non-image-forming period.

If the toner conveying member 33 is kept stopped and there is a lot of remaining amount of toner, as illustrated in FIG. 10A, there are cases in which the self-weight of the toner itself causes the pressure to be excessive such that aggregated toner is formed. The aggregated toner becomes condensed and forms an immobile layer T1 such that conveyance of the toner T to the developing roller 31 side is stopped. Accordingly, by rotating the toner conveying member 33, the toner T is loosened such that the state of the toner in the vicinity of the developing roller 31 is reset. With the above, the pressure of the toner against the developing roller 33 is prevented from becoming excessive so that the developing roller 33 is capable of carrying the toner in a favorable manner.

Figure 10B:
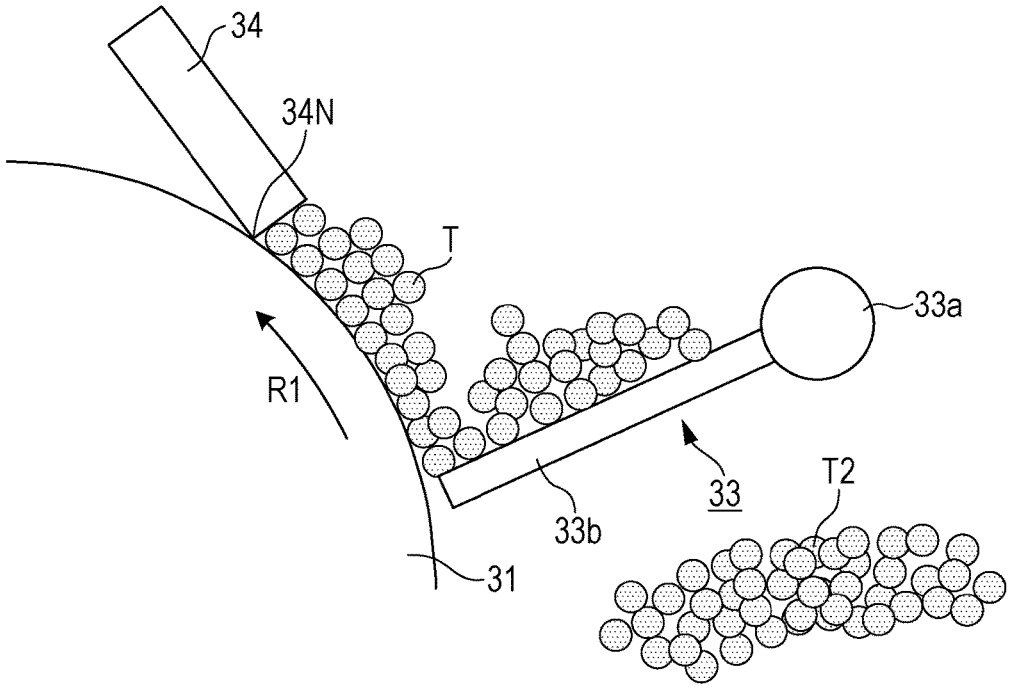

Furthermore, if the remaining amount of toner is small, as illustrated in FIG. 10B, the toner in the toner reservoir S where toner consumption is large may become partially exhausted. Accordingly, the toner conveying member 33 is rotated so that the toner is replenished and, further, so that toner T2 located far from the developing roller 31 and the toner T located gravitationally below the shaft portion 33*a* are actively conveyed to the vicinity of the developing roller 31. By so doing, the toner T inside the developer container 32 can be used efficiently.

Stoppage of Toner Conveying Member

In the present exemplary embodiment, the rotation and stoppage of the toner conveying member 33 synchronizes with the separation and abutment between the photosensitive drum 10 and the developing apparatus 3. During the abutment (the image-forming period), a rotation gear (not shown) of the toner conveying member 33 is disengaged from the drive input unit 36 such that the toner conveying member 33 is stopped. On the other hand, during the separation (the non-image-forming period), the rotation gear of the toner conveying member 33 and the drive input unit 36 are engaged to each other such that the toner conveying member 33 is operated.

Accordingly, a control unit 99 (see FIG. 1) inside the image forming main body is capable of controlling the stop position of the toner conveying member 33 by controlling the abutment and separation drive unit 65 and a separation time of the non-image-forming period. Furthermore, the control unit 99 is capable of setting the toner conveying member 33 in the stop position during at least a portion of the image-forming period.

Figure 11A:
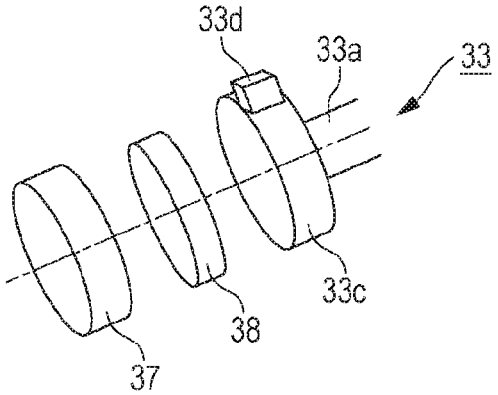
FIGS. 11A to 11C are diagrams for describing an exemplary configuration stopping the toner conveying member of the first exemplary embodiment.

Another method of rotating and stopping the toner conveying member 33 will be described with reference to FIGS. 11A to 11C. As illustrated in FIG. 11A, the toner conveying member 33 includes a conveyance drive member 33*c* that drives the toner conveying member 33. The conveyance drive member 33*c* is provided with a conveyance position determination portion 33*d* described later that abuts against a stopper member.

The developing apparatus 3 includes a conveyance input member 37 to which drive from the drive input unit 36 is input and that drives the conveyance drive member 33*c*. The conveyance input member 37 is disposed so as to be coaxial with the conveyance drive member 33*c*. Furthermore, the conveyance input member 37 is connected to the conveyance drive member 33*c* while having a friction member 38 serving as a differential absorption member interposed between the conveyance input member 37 and the conveyance drive member 33*c*.

Figure 11B:
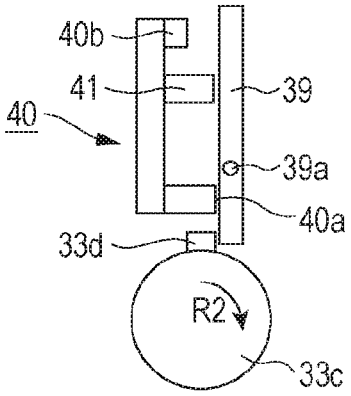

As illustrated in FIG. 11B, the developing apparatus 3 is provided with a stopper member 39 that abuts against the conveyance position determination portion 33*d* and that stops the toner conveying member 33, and a stopper restriction portion 40 that determines the position of the stopper member 39.

As illustrated in FIG. 11B, the stopper member 39 rotates about a shaft 39*a* and abuts against a first abutment portion 40*a* of the stopper restriction portion 40 so as to be in a locked state that stops the conveyance position determination portion 33*d*. Furthermore, as illustrated in FIG. 11C, the stopper member 30 can be in a released state in which the stopper member 39 is abutted against a second abutment surface 40*b* of the stopper restriction portion 40 and is separated from the conveyance position determination portion 33*d*.

As illustrated in FIG. 11B, during the image-forming period, the stopper member 39 is brought to the locked state with a spring 41. In the above, the conveyance position determination portion 33*d* is disposed at a position that, when abutted against the stopper member 39, sets the toner conveying member 33 in the stop position.

Figure 11C:
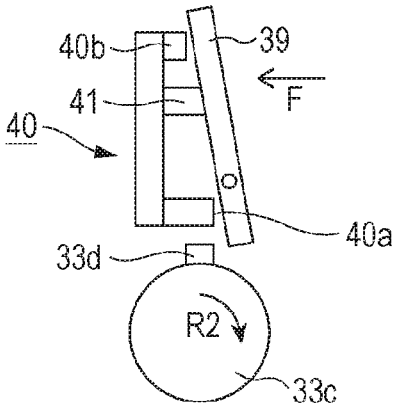

On the other hand, as illustrated in FIG. 11C, when separating the photosensitive drum 10 and the developing roller 31 from each other, the stopper member 39 is pressed in an F-direction by the abutment and separation drive unit 65 (see FIG. 1) and is brought to the released state. In the above, the stopper member 39 is separated from the conveyance position determination portion 33*d* allowing the conveyance drive member 33*c* to rotate freely. The stopper member 39 is capable of switching between the locked state and the released state in the above manner.

During the image-forming period, the conveyance input member 37 receiving a drive from the drive input unit 36 attempts to rotate the conveyance drive member 33*c* in an R2-direction through the friction member 38. However, since the conveyance position determination portion 33*d* abuts against the stopper member 39, the friction member 38 slips and the conveyance drive member 33*c* does not move.

On the other hand, when the photosensitive drum 10 and the developing roller 31 are separated from each other, as described above, the conveyance drive member 33*c* is capable of rotating freely. Accordingly, the conveyance input member 37 can rotate the conveyance drive member 33*c* through the friction member 38.

When the photosensitive drum 10 and the developing roller 31 are abutted against each other once more, the pressure of the abutment and separation drive unit 65 is released, the stopper member 39 is brought to the locked state once more, and the conveyance position determination portion 33*d* is stopped at a desired phase.

Note that the differential absorption member may be a member other than the friction member 38. Moreover, the conveyance drive member 33*c*, the conveyance position determination portion 33*d*, and the friction member 38 may be provided at positions different from those described in the present exemplary embodiment as long as the toner conveying member 33 can be positioned in the stop position.

In the present exemplary embodiment, the toner conveying member 33 is configured to interlock with the operation of separating and abutting the photosensitive drum 10 and the developing roller 31 from and against each other, and to stop the conveyance drive member 33*c* during the image-forming period. However, the present disclosure is not limited to the above configuration. In other words, it is only sufficient that the toner conveying member 33 can be positioned in the stop position during the image-forming period. For example, the toner conveying member 33 may be positioned in the stop position by controlling a separate drive member (a stepping motor or the like). Furthermore, the stopper member 39 may be moved by a separate drive member and a separate control unit.

Furthermore, in the present exemplary embodiment, the configuration of the toner conveying member 33 in which the conveying portion 33*b* rotates about the center of the shaft portion 33*a* has been described; however, other configurations may be adopted. In other words, it is only sufficient that the toner conveying member 33 is capable of mixing the toner T, and is capable of being stopped during the image-forming period such that the toner reservoir S is formed in the vicinity of the developing roller 31*b*. Accordingly, the conveying member 33 may be configured so that the conveying portion 33*b* swings, or so that a link mechanism or the like is connected to the shaft portion 33*a* so that the conveying member 33 reciprocates with respect to the developing roller 31.

As described above, in the configuration of the first exemplary embodiment of the present disclosure, by having the toner conveying member 33 operate during the non-image-forming period and stop during the image-forming period, the toner conveying member 33 is made to perform two roles, namely, mixing the toner and supplying the toner. With the above, aggregation of the toner T can be eliminated during the non-image-forming period by operating the toner conveying member 33, and the toner reservoir S can be formed during the image-forming period by stopping the toner conveying member 33. Furthermore, a desirable toner circulation W can be achieved with the abutting portion 34N. With the above, toner can be supplied while using the weight of the toner itself efficiently; accordingly, while miniaturization and simplification of the configuration of the developing apparatus 3 are achieved, supply of toner to the developing roller 31 can be performed in a stable manner.

Second Exemplary Embodiment

A second exemplary embodiment of the present disclosure will be described with reference to FIGS. 12A to 12C.

Note that in the present exemplary embodiment, description of components that are different from those of the first exemplary embodiment will be given, and description of components that are similar to those of the first exemplary embodiment will be omitted.

A feature of the present exemplary embodiment is that instead of the developing roller 31 described in the first exemplary embodiment, a developing roller 131 configured so that dielectric portions capable of holding a charge, and a conductive portion adjacent to the dielectric portions are provided having minute areas exposed and mixed in the front surface is used.

Figure 12A:
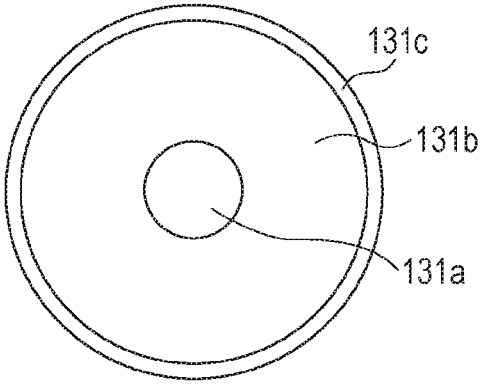
FIGS. 12A to 12C are diagrams for describing a developing roller used in a second exemplary embodiment.

As illustrated in FIG. 12A, the developing roller 131 includes a shaft core 131*a* on the outer periphery thereof, and an elastic layer 131*b* formed of an electroconductive rubber material. Moreover, the developing roller 131 includes, in the front surface, a front surface layer 131*c* in which dielectric portions (second volume resistive portions) 131*d* having a volume resistivity of 10^13 Ωcm or more are scattered in a conductive portion (first volume resistive portion) 131*e* having a volume resistivity of 10^11 Ωcm or less. In other words, the surface of the developing roller 131 that carries the toner T is configured such that a plurality of dielectric portions are scattered on a surface formed of a conductive portion. The developing roller 131 can be fabricated by forming a front surface layer, which is formed of a conductive resin material in which dielectric particles have been dispersed, on the elastic layer 131*b* by coating, for example, and by grinding the front surface of the front surface layer.

Figure 12B:
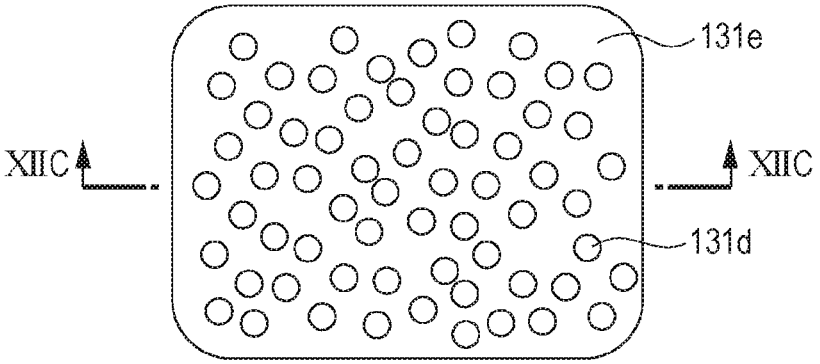
Figure 12C:
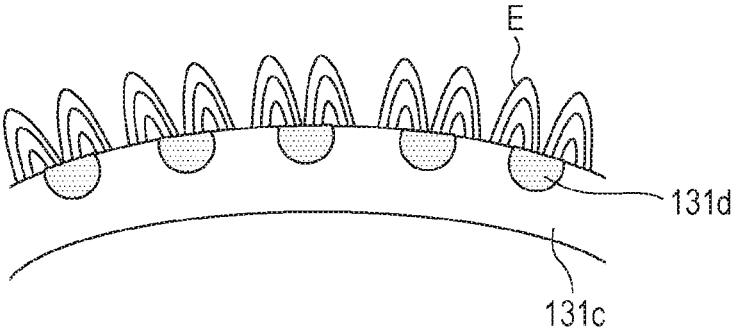

A plan view of the developing roller 131 is illustrated in FIG. 12B, and a cross-sectional view thereof is illustrated in FIG. 12C. FIG. 12C is a cross section that corresponds to a (cutting) position XIIC-XIIC shown in FIG.12B. Minute closed electric fields (microfields) that are depicted by lines of electric force E illustrated in FIG. 12C are formed by charging the dielectric portions 131. Desirably, the outside diameter of each dielectric portion 131*d* is about 5 to 500 pm. The above outside diameter is an optimum value for maintaining the charge on the front surface and suppressing unevenness in the image. When outside diameter >5 μm holds true, a sufficient charge can be maintained and sufficient minute closed electric fields can be formed on the front surface of the dielectric portions 131*d*.

The charge of the dielectric portions 131*d* described above becomes larger as the opportunity of sliding between the toner T and the developing roller 131 increases. In other words, as the movement of the toner T on the front surface of the developing roller 131 becomes larger, the amount charged in the dielectric portions 131*d* becomes larger. In order to increase the movement of the toner T on the front surface of the developing roller 131, all one has to do is to make the toner circulation W active, which has been described in the first exemplary embodiment. In order to make the toner circulation W active, one only has to provide the restriction portion (the abutting portion 34N and the like in the first exemplary embodiment) and operate the toner conveying member 33 in a similar manner to that of the first exemplary embodiment. With the above, the amount of charge in the dielectric portions is increased, and minute closed electric fields are formed in the adjacent portions between the dielectric portions and the conductive portion. Furthermore, the toner conveyed to the toner reservoir S in the vicinity of the developing roller 131 with the toner conveying member 33 receives gradient force and is drawn to and carried on the front surface of the developing roller 131.

As described above, in the present exemplary embodiment, not only the toner on the front surface of the developing roller 131 but the dielectric portions formed in the front surface of the developing roller 131 can be charged with the toner circulation W in the vicinity of the developing roller 131. Accordingly, more minute closed electric fields can be formed such that the gradient force drawing the toner increases and a large amount of toner can be carried.

Third Exemplary Embodiment

A third exemplary embodiment of the present disclosure will be described with reference to FIGS. 13 to 14D.

A feature of the present exemplary embodiment is that, in a case in which formation of images is performed continuously on a plurality of recording materials P, the toner conveying member 33 is moved during the formation of the image transferred to the preceding recording material P and during the formation of the image transferred to the succeeding recording material P. With the above, the toner in the vicinity of the developing roller 31 is loosened and the supplying of the toner to the developing roller 31 stabilized.

Note that components other than the toner conveying member are the same as those of the first and second exemplary embodiments. In the present exemplary embodiment, components that have configurations that are different from those described in the first exemplary embodiment will be described.

Figure 13:
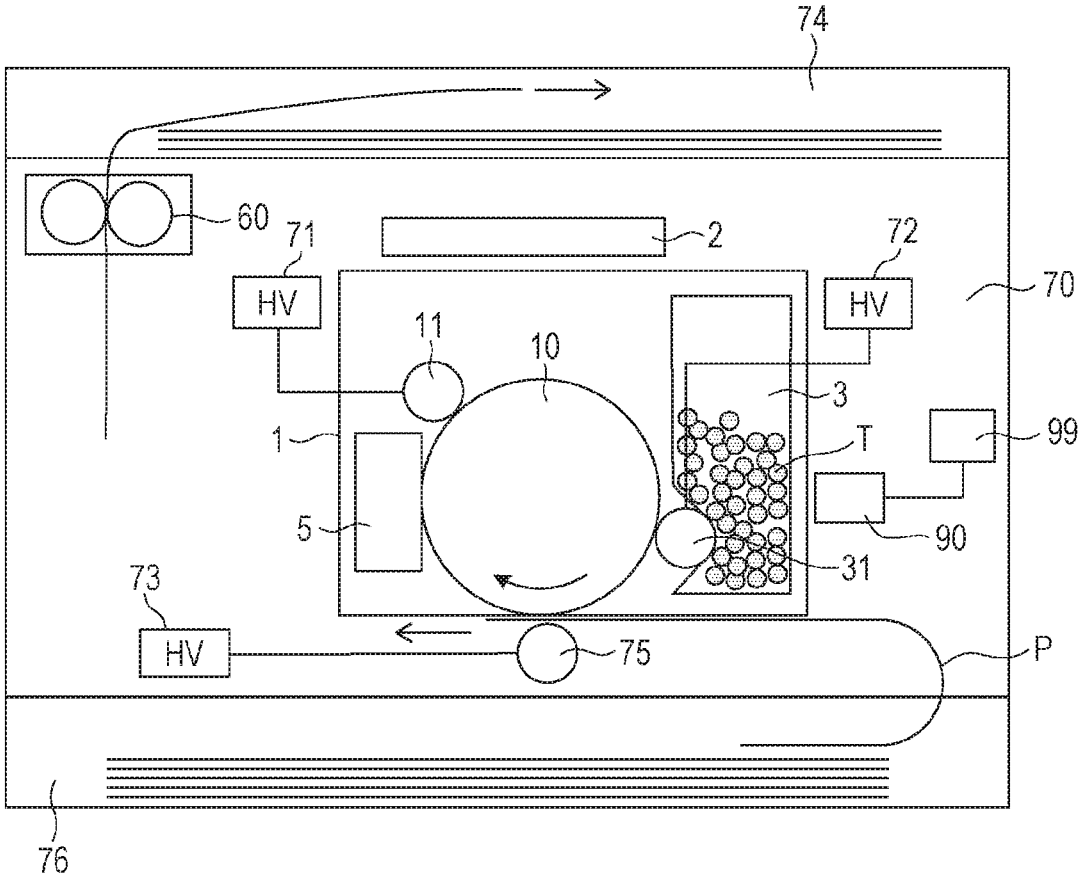
FIG. 13 is a diagram for describing an image forming apparatus according to a third exemplary embodiment.

FIG. 13 is a cross-sectional view of the image forming apparatus used in the present exemplary embodiment.

A pivot drive unit 90 that drives a pivoting member described later on the basis of image information sent from an information processing device (not shown) is provided in the image forming apparatus of the present exemplary embodiment. The pivot drive unit 90 is controlled with the control unit 99.

An operation of the toner conveying member 33 according to the present exemplary embodiment will be described with reference to FIGS. 14A to 14D.

Figure 14A:
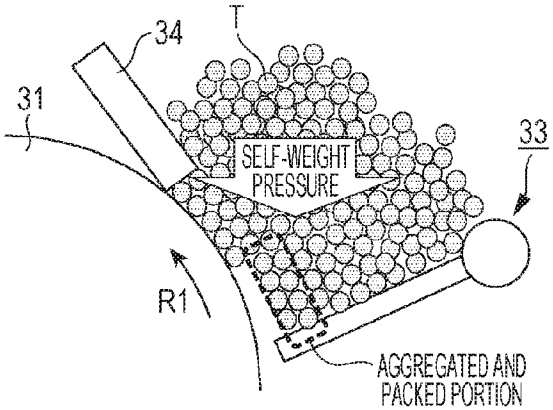
FIGS. 14A to 14D are diagrams for describing an operation of a toner conveying member according to the third exemplary embodiment.
Figure 14B:
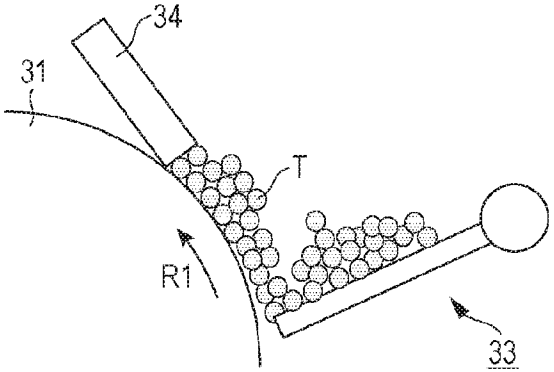

As described above, during the image-forming period, the toner conveying member 33 needs to be stopped such that the toner reservoir S is formed in the vicinity of the developing roller 31. However, if the toner conveying member 33 is kept stopped and there is a lot of remaining amount of toner, as illustrated in FIG. 14A, the self-weight of the toner itself causes the pressure to be excessive such that aggregated toner is formed. The aggregated toner becomes condensed and forms an immobile layer T1 such that supply of toner to the developing roller 31 side is stopped. Furthermore, if the remaining amount of toner is small, as illustrated in FIG. 14B, the toner in the toner reservoir S where toner consumption is large may become partially exhausted such that an appropriate carrying amount cannot be obtained. Accordingly, even in a case in which formation of images are continuously performed on the plurality of recording mediums, that is, even in a case in which continuous printing is performed, it is desirable that the toner T is loosened and a toner reservoir without any sparse and dense portions is re-formed by moving the toner conveying member 33 at a predetermined timing.

Even in a case in which continuous printing is performed, from the end of the formation of the image transferred to the preceding recording material P to the start of the formation of the image transferred to the succeeding recording material P (hereinafter, merely referred to as "in-between-recording-materials period"), no images are formed. Accordingly, the toner conveying member 33 can be operated and the toner T can be loosened during the in-between-recording-materials period. Furthermore, during the image-forming period, the toner reservoir S can be re-formed in the vicinity of the developing roller 31 by stopping the toner conveying member 33 once more. In other words, supply of toner to the developing roller 31 can be stabilized without obstructing the image forming operation.

Figure 14C:
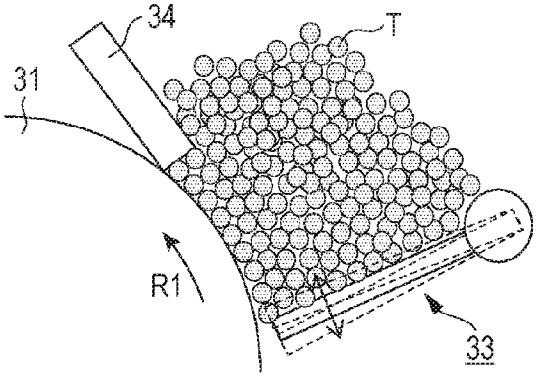
Figure 14D:
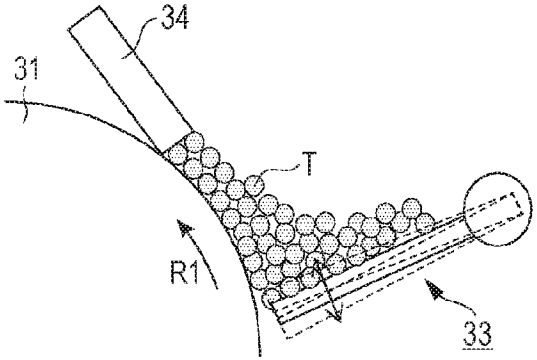

Note that the operation of the toner conveying member 33 during the in-between-recording-materials period may, as illustrated in FIGS. 14C and 14D, moving the toner conveying member 33 forward and backward in the rotation direction, that is, the operation may be a so-called pivotal movement. With the above method, the operation time can be made short compared with the method in which the toner conveying member 33 is rotated. Accordingly, the operation during the in-between-recording-materials period can be performed easily when continuous printing is performed. Accordingly, a satisfactory carrying amount can be obtained without obstructing the image forming operation by loosening the toner T and re-forming the toner reservoir without any sparse and dense portions. In other words, supply of toner to the developing roller 31 can be stabilized.

Figure 15A:
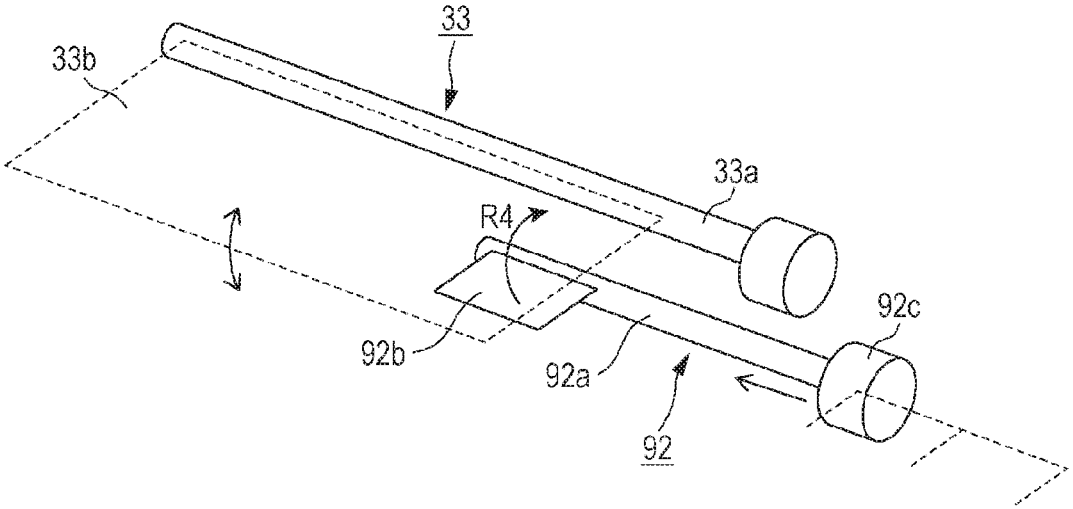
FIGS. 15A and 15B are diagrams for describing an operation of a pivoting member according to the third exemplary embodiment.
Figure 15B:
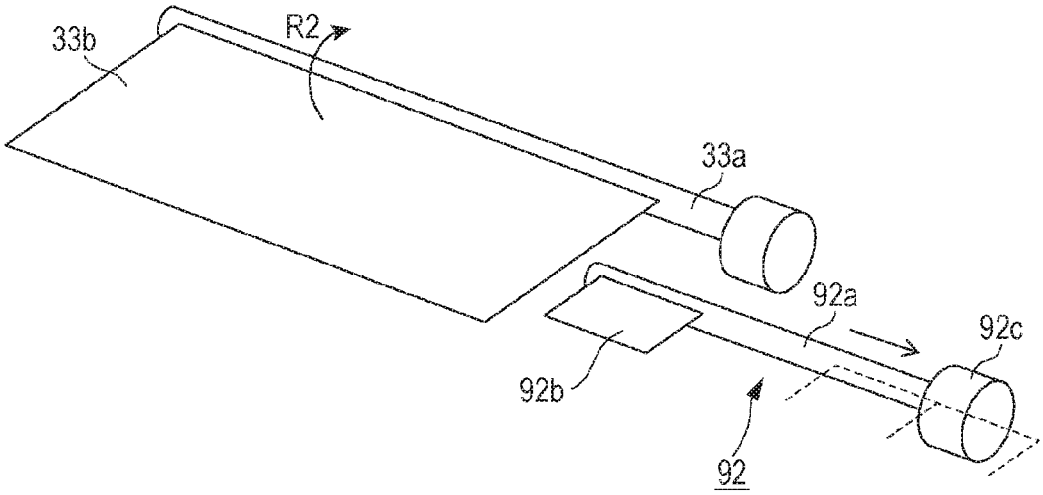

The pivotal movement of the toner conveying member 33 during the in-between-recording-materials period will be described with reference to FIGS. 15A and 15B. FIGS. 15A and 15B are drawings illustrating the toner conveying member 33 and a pivoting member 92 that pivots the toner conveying member 33. The toner conveying member 33 is in the stop position described in the first exemplary embodiment. Note that in the present exemplary embodiment, the axial direction of the shaft portion 33*a* of the toner conveying member 33 is merely referred to as a "longitudinal direction".

The pivoting member 92 that operates the toner conveying member 33 during the in-between-recording-materials period is provided in the vicinity of the toner conveying member 33. The pivoting member 92 includes a pivoting shaft 92*a*, a pivoting plate 92*b* that rotate and abuts against the conveying portion 33*b*, and a pivot input portion 92*c*. The pivoting shaft 92*a* is formed of HIPS or the like and is capable of being rotated in an arrow R4 direction by having the pivot input portion 92*c* receive an operational input from the pivot drive unit 90 illustrated in FIG. 13.

Furthermore, a spring-like abutting member (not shown) that is capable of expanding and contracting in the longitudinal direction is provided in the pivot input portion 92*c*. The pivoting member 92 is capable of moving in the longitudinal direction by expansion and contraction of the abutting member.

The pivoting plate 92*b* is formed of a thin elastic body, such as a polyethylene terephthalate (PET) sheet having a thickness of about 50 to 200 μm. The length of the pivoting plate 92*b* in a direction extending in the radius of rotation and the length thereof in the rotational axis direction are both shorter than those of the conveying portion 33*b* of the toner conveying member 33. The pivoting plate 92*b* is configured to abut against the conveying portion 33*b* of the toner conveying member 33 in the stop position when the pivoting member 92 is rotated.

FIG. 15A illustrates an operation of the pivoting member 92 during the in-between-recording-materials period.

The pivoting member 92 receiving an operational input from the pivot drive unit 90 illustrated in FIG. 13 moves in the longitudinal direction. Furthermore, upon rotation of the pivoting member 92, the pivoting plate 92*b* moves into a position coming into contact with the conveying portion 33*b*. Subsequently, upon rotation of the pivoting member 92, the pivoting plate 92*b* abuts against the conveying portion 33*b*. In the above, since the conveying portion 33*b* is at a stop, the conveying portion 33*b* does not rotate. Furthermore, the conveying portion 33*b* is deformed by the elasticity of the pivoting plate 92*b* and that of the conveying portion 33*b*, and the toner conveying member 33 is moved forward and backward in the rotation direction.

An operation of the pivoting member 92 during periods other than the in-between-recording-materials period is next described in FIG. 15B.

The pivoting member 92 receiving an operational input from the pivot drive unit 90 illustrated in FIG. 13 moves in the longitudinal direction. Subsequently, the pivoting member 92 is retracted to a position where the conveying portion 33*b* does not come into contact with the pivoting plate 92*b* even when the toner conveying member 33 is rotated. By so doing, the operation of the toner conveying member 33 during the non-image-forming period described in the first exemplary embodiment is not interrupted.

In the present exemplary embodiment, particularly, a configuration in which the toner conveying member 33 is pivotally moved using the pivoting member 92 has been described in detail; however, the present disclosure is not limited to the above configuration. The movement of the toner conveying member 33 during the non-image-forming period, as described in the first exemplary embodiment, may be performed during the in-between-recording-materials period.

As described above, by moving the toner conveying member 33 during the in-between-recording-materials period, the toner can be loosened and the supply of toner to the developing roller 31 can be stabilized without obstructing the image formation operation when the operation of continuously forming images on a plurality of recording materials is carried out.

Fourth Exemplary Embodiment

A fourth exemplary embodiment of the present disclosure will be described with reference to FIGS. 16 and 17.

A feature of the present exemplary embodiment is that the operation of the toner conveying member is performed by a stepping motor or the like that operates while synchronizing with pulse power and that is capable of reverse rotation.

Note that components other than the toner conveying member are the same as those of the first and second exemplary embodiments.

Figure 16:
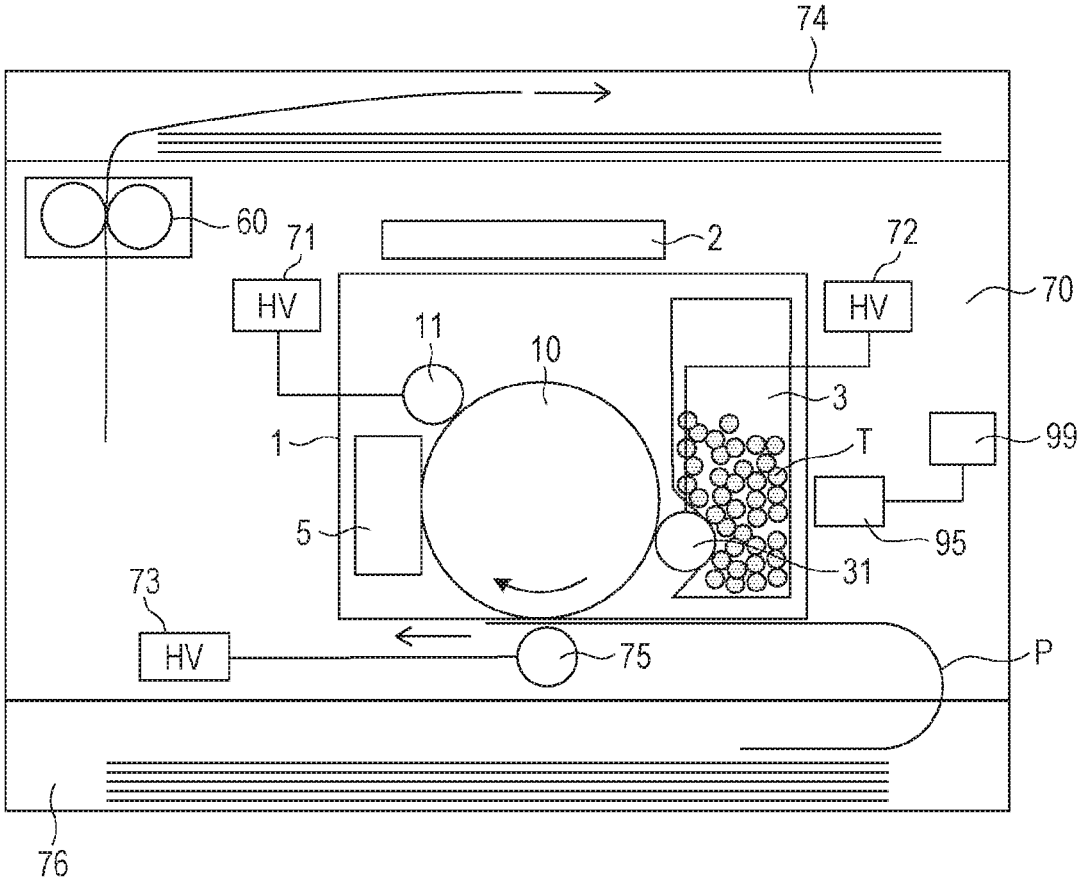
FIG. 16 is a diagram for describing an image forming apparatus according to a fourth exemplary embodiment.
Figure 17:
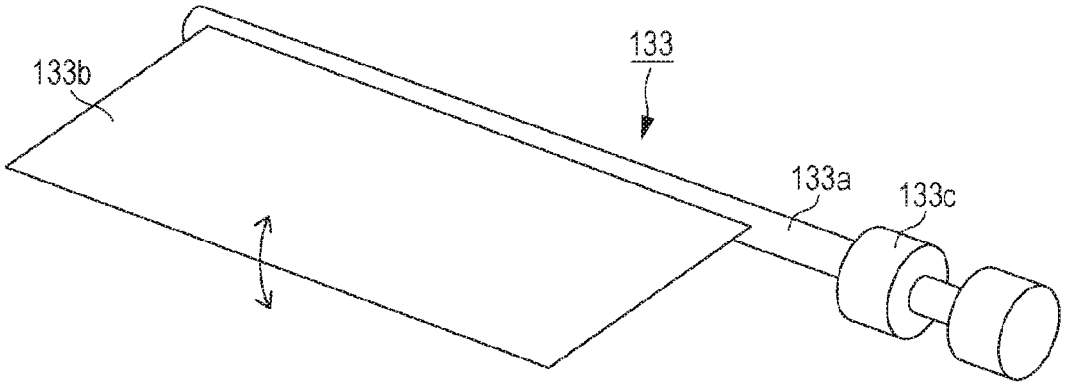
FIG. 17 is a diagram for describing a toner conveying member according to the fourth exemplary embodiment.

FIG. 16 is a drawing of the image forming apparatus used in the present exemplary embodiment. FIG. 17 is a drawing illustrating a toner conveying member 133 used in the present exemplary embodiment.

The image forming apparatus is provided with a stepping motor 95 that rotates and stops the toner conveying member 133. The stepping motor 95 is controlled with the control unit 99.

A conveyance drive member 133*c* that receives the drive from the stepping motor 95 is provided in a shaft portion 133*a* of the toner conveying member 133. The conveyance drive member 133*c* and the stepping motor 95 are configured so as to be connected to a specific phase. Furthermore, the conveyance drive member 133*c* and a conveying portion 133*b* are also configured to be at a specific phase in the rotation direction of the toner conveying member 133.

In other words, the image forming apparatus according to the present exemplary embodiment is capable of independently controlling the operation and stoppage of the toner conveying member 133 with the stepping motor 95 and is capable of directly controlling the stop position of the toner conveying member 133.

During the image-forming period, the toner conveying member 133 is controlled so as to be in the stop position to form the toner reservoir S, such as the one described in the first exemplary embodiment. Furthermore, during the non-image-forming period, the toner conveying member 133 can be moved and the toner T can be loosened.

Moreover, the toner conveying member 133 can be rotated during the in-between-recording-materials period as well when images are formed on a plurality of recording materials. Furthermore, a motion of alternatively repeating a rotation in the forward direction and the rotation in the backward direction can be transmitted to the conveyance drive member 133*c* so that the toner conveying member 133 is moved towards the front and back in the rotation direction.

As described above, the toner conveying member 133 can be moved with a stepping motor 95, and the operation and stoppage of the toner conveying member 133 can be controlled. Accordingly, supply of toner to the developing roller 31 can be performed in a stable manner. Furthermore, the toner conveying member 133 can be moved and the toner T can be loosened during the in-between-recording-materials period. Accordingly, the supply of toner to the developing roller 31 can be stabilized without obstructing the image formation operation when formation of images on a plurality of recording materials is continuously carried out.

Fifth Exemplary Embodiment

Figure 18:
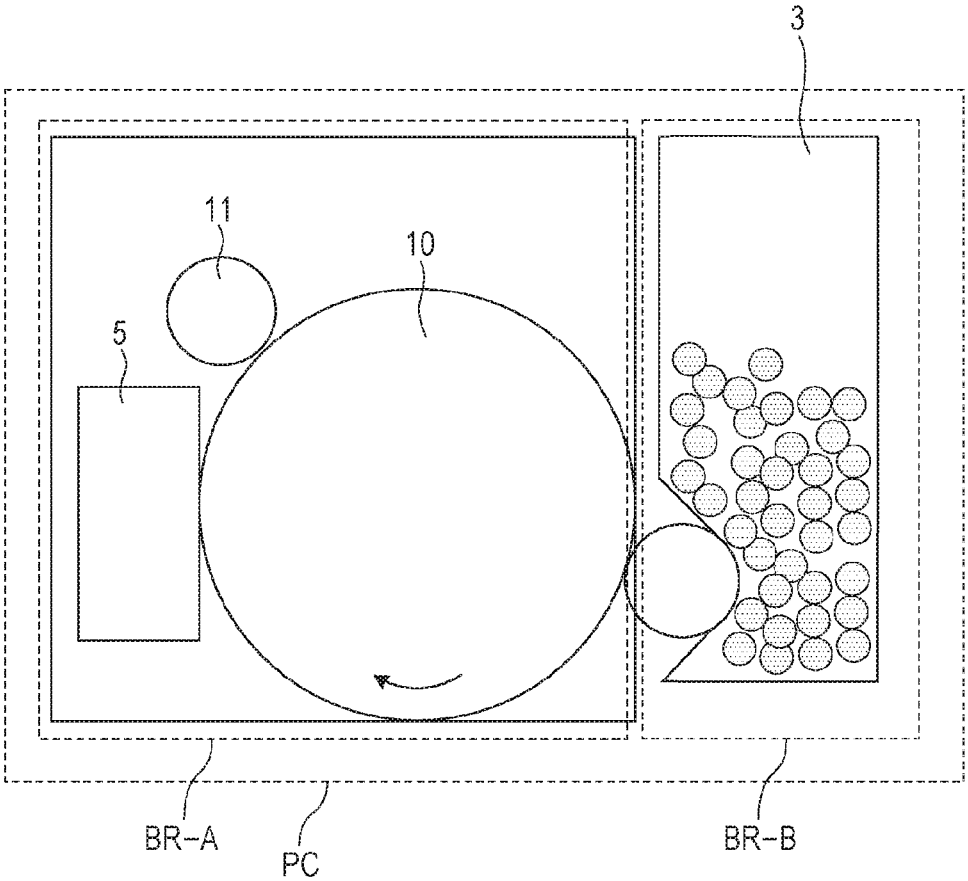
FIG. 18 is a diagram for describing a process cartridge of a fifth exemplary embodiment.

A fifth exemplary embodiment of the present disclosure will be described with reference to FIG. 18.

A feature of the present exemplary embodiment is that the photosensitive drum 10, the charging roller 11, the cleaning device 5, and the developing apparatus 3 are incorporated in an integrated manner as a process cartridge PC that is detachable from the image forming apparatus main body.

By employing such a cartridge system, it goes without saying that a similar effect as that of the first exemplary embodiment can be obtained. Furthermore, the maintenance load can be reduced and an image forming apparatus with excellent usability can be provided.

Note that the process cartridge PC may be configured so as to be capable of being divided into a block BR-A and a block BR-B surrounded by broken lines.

Sixth Exemplary Embodiment

Image Forming Apparatus and Process Cartridge

The image forming apparatus to which the present disclosure is applied includes a copier, a laser beam printer (LBP), a printer, a fax machine, a microfilm reader-printer, and a recording machine, which employ an image forming process adopting an electrophotographic printing method. Such image forming apparatuses fixes an unfixed developer image that is formed and carried on a recording material (a transfer material, a printing sheet, photosensitive paper, electrostatic recording paper, etc.) by using an intermediate transfer system or a direct transfer system in an image forming process unit. Note that the left-right direction in each diagram coincides with the horizontal direction and the up-down direction coincides with the vertical direction. In other words, gravitational force acts from the upper side towards the lower side of each drawing.

Figure 19:
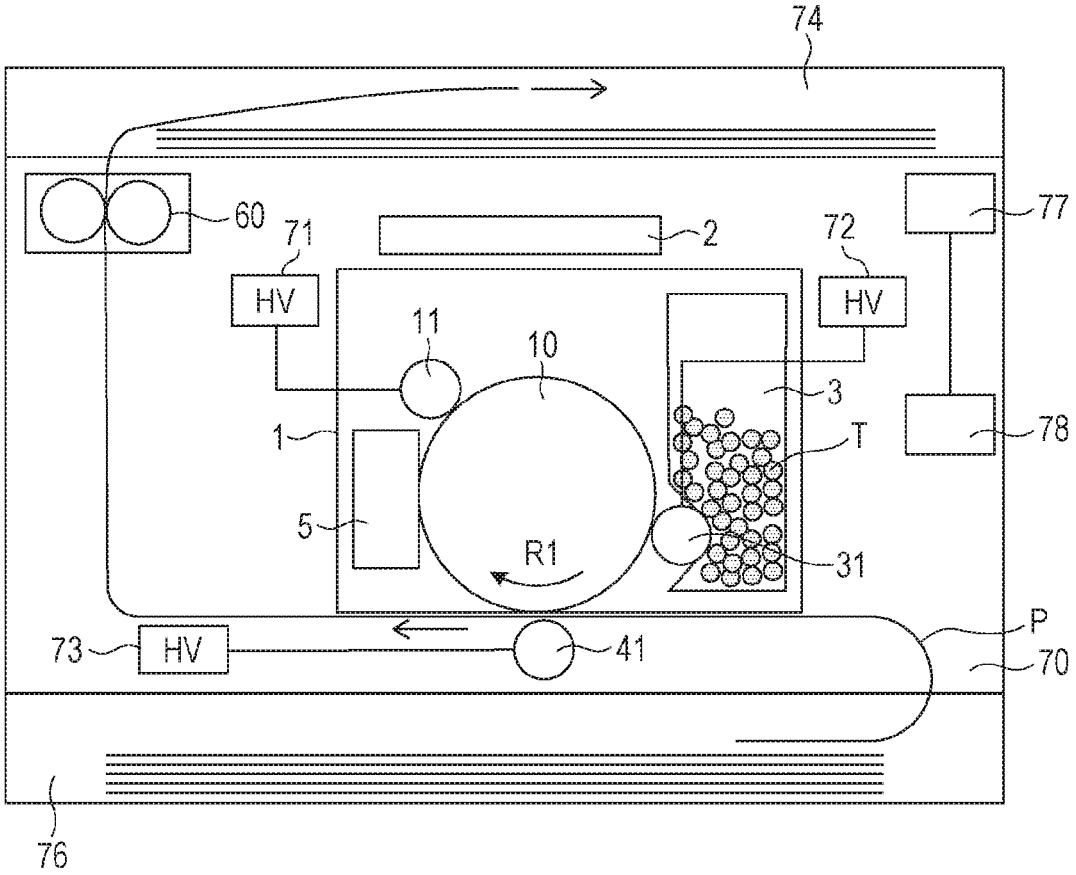
FIG. 19 is a schematic cross-sectional view of an image forming apparatus of a sixth exemplary embodiment.

Referring to FIG. 19, an image forming apparatus according to a sixth exemplary embodiment of the present disclosure will be described. FIG. 19 is a schematic cross-sectional view illustrating a schematic configuration of a laser beam printer that is an example of the image forming apparatus according to a sixth exemplary embodiment. As illustrated in FIG. 19, the image forming apparatus according to the sixth exemplary embodiment includes a detachable process cartridge 1 inside an image forming main body 70. A photosensitive drum that is an image carrying member is provided so as to be rotatable in an R1-direction. In order to uniformly charge the photosensitive drum 10, a predetermined direct current voltage is applied to a charging roller 11, which is a charging member, from a voltage applying member 71 for a charging device provided inside the image forming main body 70. In order to form an electrostatic latent image on a front surface of the photosensitive drum 10, an exposing device 2, which is an optical member, emits a modulated laser beam based on image information sent from an information processing device (not shown) onto the front surface of the photosensitive drum 10. A negatively charged non-magnetic mono-component developer T (hereinafter, referred to as toner) is contained in a developing apparatus 3, which is a developing member. The developing apparatus 3 applies a predetermined direct current voltage to a developing roller with a voltage applying member 72 for the developing apparatus and supplies the toner to the front surface of the photosensitive drum 10 to develop an electrostatic latent image on the front surface of the photosensitive drum 10 such that a visible image (hereinafter, referred to as a toner image) is formed on the front surface of the photosensitive drum 10. In order to transfer the toner image (a developer image) on the photosensitive drum 10 to a recording material P conveyed from a cassette 76 so as to synchronize with the formation of the toner image, a predetermined voltage is applied to a transferring roller 41, which is a transfer member, with a voltage applying member 73 for the transfer device. In the above, most of the toner image is transferred to the recording material P; however, a portion remains on the photosensitive drum 10. The remaining toner is collected by a cleaning device 5. Furthermore, a fixing device 60, which is a fixing unit, fixes, with heat and pressure, the toner image transferred to the recording material P as a permanent image on the recording material. The recording material P on which fixing has been completed is accumulated on a sheet discharge tray 74.

Developing Apparatus

Figure 20:
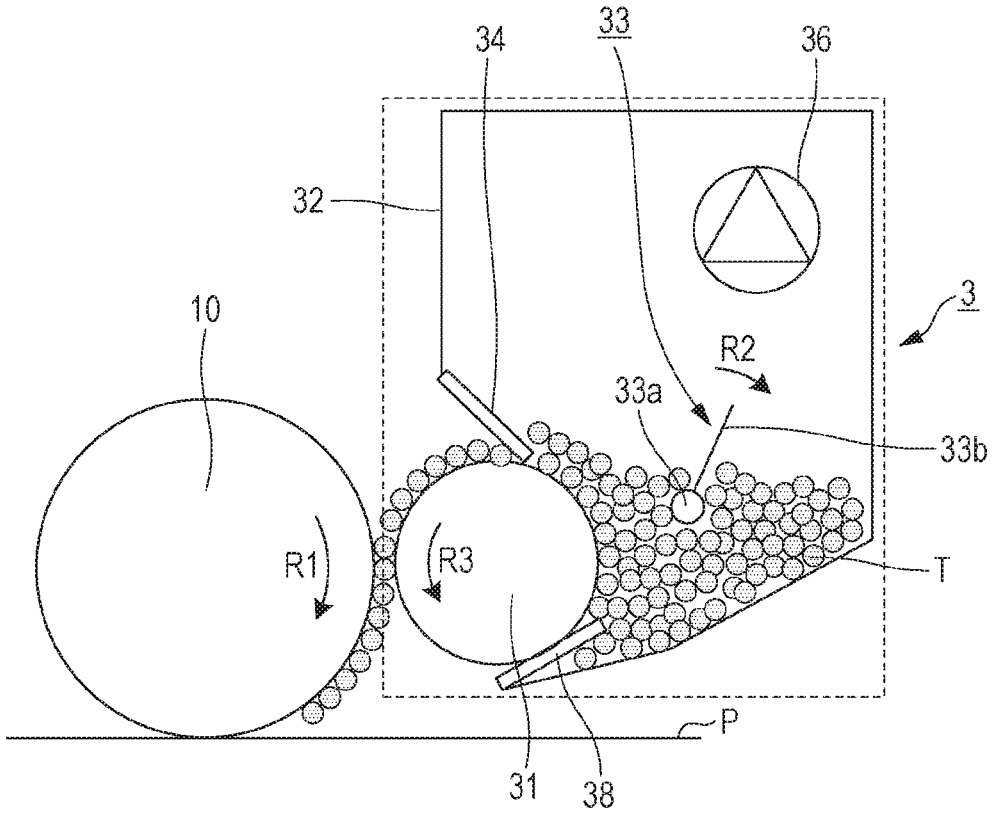
FIG. 20 is a schematic cross-sectional view of a developing apparatus of the sixth exemplary embodiment.

Referring to FIG. 20, a configuration of the developing apparatus 3 according to the sixth exemplary embodiment of the present disclosure will be described. FIG. 20 is a schematic cross-sectional view illustrating a schematic configuration of the developing apparatus 3 according to the sixth exemplary embodiment. The developing apparatus 3 includes at least a toner T, which is developer, a developing roller 31, which is a rotatable developer carrying member, a development frame body 32, a toner conveying member 33, which is a second member or a second restriction member, and a developing blade 34 serving as a first member or a first restriction member. Toner is accommodated in an internal space, which is a developer accommodating chamber of the development frame body 32, and a developing roller is rotatably disposed in a position that closes an opening provided on the lower side of the accommodating chamber. An underside of the accommodating chamber is an inclined surface that is inclined downwards towards the developing roller 31. The toner accommodated in the development frame body 32 is moved towards the developing roller by its own weight, the inclination on the underside of the accommodating chamber, and the rotation of the toner conveying member 33. Furthermore, the developing apparatus 3 includes a flexible sheet 38 that is provided in the development frame body 32 so as to abut against the developing roller 31 at an area different from the area in which the developing blade 34 abuts and that prevents the toner from leaking to the outside of the accommodating chamber form the gap between the opening and the developing roller 31. The toner T has a non-magnetic negative chargeability, and a material such as, for example, a non-magnetic styrene-acryl-based+polyester-based resin is used.

Figure 22A:
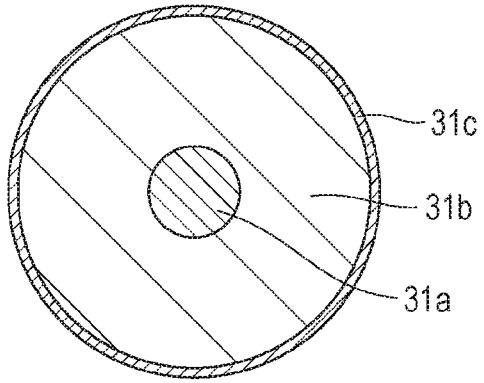
FIGS. 22A to 22C are schematic diagrams illustrating a configuration of the developing roller of the sixth exemplary embodiment.

The developing roller 31 carries the toner T and is disposed in an opening at the lower portion of the developer frame body 32. As illustrated in FIG. 22A, as the developing roller 31 of the present exemplary embodiment, a developing roller in which the toner carrying surface is configured such that a plurality of dielectric portions that is capable of holding a charge on the front surface formed of a conductive portion are scattered and exposed in minute areas. Specifically, the developing roller 31 includes an elastic layer 31*b* formed on an electroconductive rubber material on the outer periphery of a shaft core 31*a*, and a front surface layer 31*c* including a conductive portion 31*c*1 having a volume resistivity of $1\times10^{11}$ Ωcm or less, and dielectric portions 31*d* having a volume resistivity of $1\times10^{13}$ Ωcm or more. The developing roller 31 can be fabricated by forming a front surface layer, which is formed of a conductive resin material in which dielectric particles have been dispersed, on the elastic layer 31*b* by coating, for example, and by grinding the front surface of the front surface layer.

The development frame body 32 accommodates the toner T and corresponds to a developer accommodating portion or the developing apparatus. The toner conveying member 33 includes a shaft portion 33*a* and a conveying portion (sheet-like portion) 33*b*. The shaft portion 33*a* is formed of HIPS or the like and is capable of rotating inside the developer accommodating chamber of the development frame body 32 in an arrow R2-direction. Upon rotation of the shaft portion 33*a*, the angle of the surface of the conveying portion 33*b* extending from the shaft portion 33*a* towards the developing roller 31 changes, and the position of the front surface of the developing roller 31 close to the toner conveying member 33 changes. The conveying portion 33*b* is formed of a thin elastic body, such as a polyethylene terephthalate sheet having a thickness of about 50 to 200 μm, and conveys the toner T to a portion close to the developing roller 31. The developing blade 34 constituted of a plate formed of metal, such as an SUS, having a thickness of about 50 to 120 μm abuts against the developing roller 31 at a contact pressure of about 10 to 50 gf/cm so as to restrict the toner on the developing roller 31 to a substantially uniform thickness. With the configuration described above, the developing apparatus 3 supplies the toner T that is carried by the developing roller 31 and in which the amount thereof has been restricted by the developing blade 34 to the photosensitive drum 10.

Before the image formation, the developing roller 31 and the photosensitive drum 10 are separated from each other with a gap of about 100 μm. Upon reception of an image forming signal, the image forming main body performs a driving input operation to a drive input unit 36 of the developing apparatus with a drive member (not shown) such that rotational drive is started. Subsequently, an abutting operation between the photosensitive drum 10 and the developing roller 31 is performed with an abutting and separating mechanism. In the present exemplary embodiment, while the developing roller 31 and the photosensitive drum 10 are abutted against each other, the drive input unit 36 meshed with a rotation gear of the developing roller 31 rotates the developing roller 31 (in an R3-direction). On the other hand, while the developing roller 31 and the photosensitive drum 10 are separated from each other, the drive input unit 36 meshes with a rotation gear of the toner conveying member 33 and rotates the toner conveying member 33 (in the R2-direction). In other words, the toner conveying member 33 is rotationally driven only during the separation and is stopped during the abutment. The reason for employing such a mechanism will be described later.

Toner Coating Mechanism of Developing Roller

Figure 21:
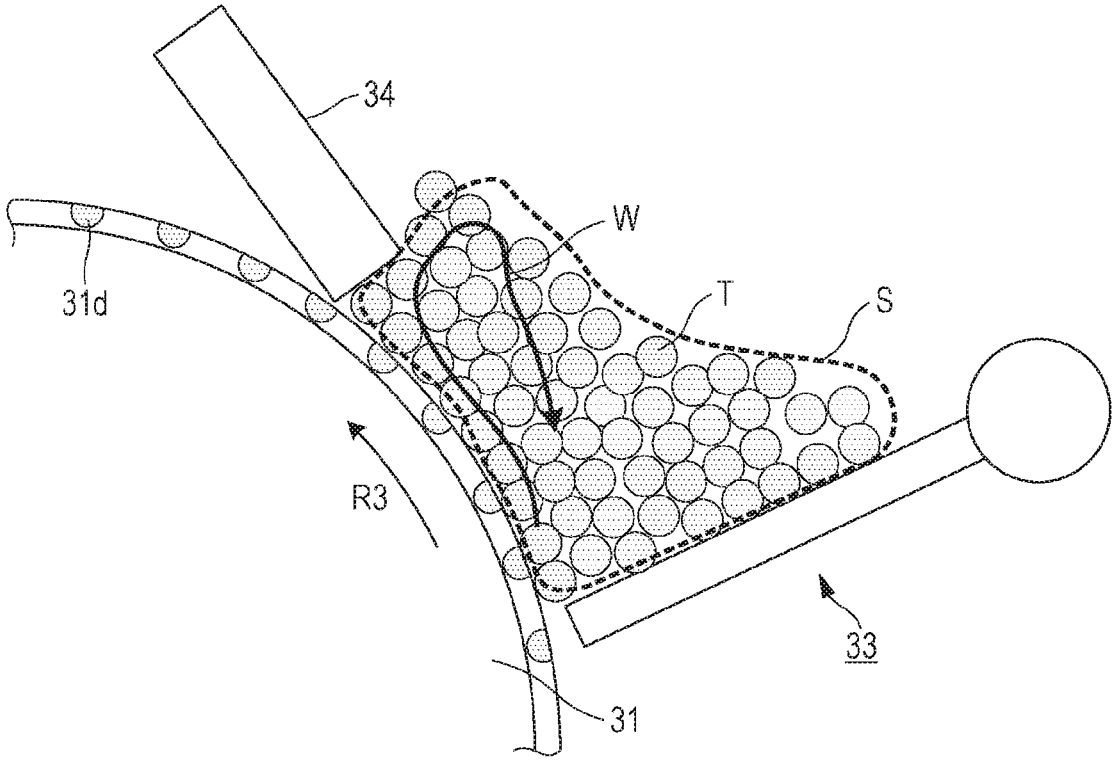
FIG. 21 is a diagram for describing a mechanism for coating toner onto a developing roller.

Referring to FIGS. 21, 22A, 22B, and 22C, a mechanism for coating toner onto the developing roller 31 will be described. FIG. 21 is a schematic cross-sectional view for describing the mechanism for coating toner onto the developing roller 31. Coating of toner onto the developing roller 31 can be achieved by forming a toner circulation W and a toner reservoir S illustrated in FIG. 21. When the toner circulation W as illustrated in FIG. 21 is formed, the flow of the toner driven up along a front surface of the developing roller 31 by the rotary force of the developing roller 31 is restricted by the developing blade 34, and toner rolling on the developing roller 31 in the arrow R3 direction is charged due to the rolling friction with the restricted toner T moving towards the lower side of the container. When the toner T on the developing roller 31 is charged, the charged toner T and the dielectric portions 31*d* on the developing roller are slid against each other charging the dielectric portions 31*d*.

Figure 22B:
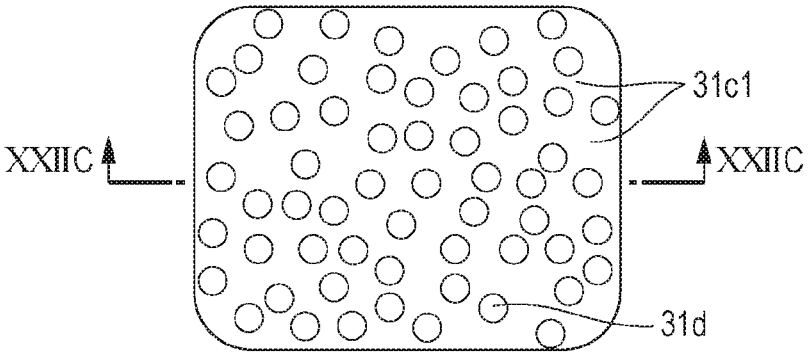
Figure 22C:
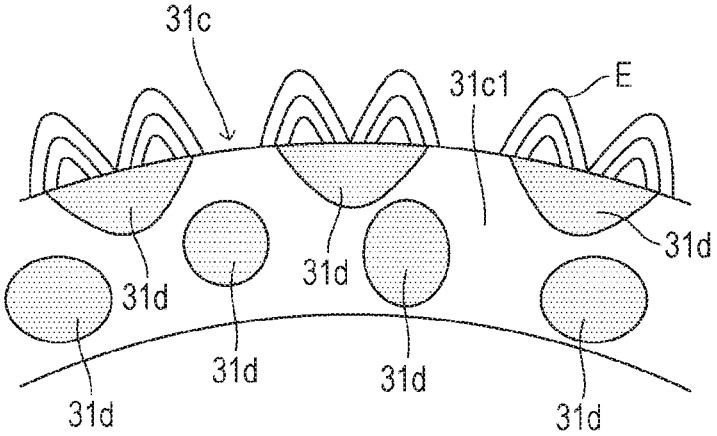

A plan view of the front surface layer 31*c* of the developing roller 31 is illustrated in FIG. 22B, and a cross-sectional view taken along line XXIIC-XXIIC in FIG. 22B is illustrated in FIG. 22C. Minute closed electric fields (microfields) that are depicted by lines of electric force E illustrated in FIG. 22C are formed between the dielectric portions 31*d* and the conductive portion 31*c*1 by charging the dielectric portions 31*d*. Receiving the gradient force created by the minute closed electric fields, non-charged toner T in the vicinity of the developing roller 31 is drawn to and carried by the front surface of the developing roller 31.

Desirably, the size of each dielectric portions 31*d* (the size of the portion (a circular portion) that is exposed to the peripheral surface of the developing roller 31 (the conductive portion 31*c*1) is about 5 to 500 μm in diameter, for example. The above diameter is an optimum value for adhering the required toner on the developing roller 31 to maintain the charge on the front surface and suppress unevenness in the image. When diameter ≥5 μm holds true, a sufficient charge can be maintained and sufficient minute closed electric fields can be formed on the front surface of the dielectric portions 31*d*. When diameter <5 μm holds true, the amount of potential held on the front surface of the dielectric portions 31*d* is small and sufficient minute closed electric fields cannot be formed. Furthermore, when diameter >500 μm holds true, the potential difference between the dielectric portions 31*d* and the conductive portion 31*c*1 will become large and the image will become one with a lot of unevenness.

The charge of the dielectric portions 31*d* described above becomes larger as the sliding opportunity between the toner and the developing roller increases. In other words, as the movement of the toner on the front surface of the developing roller becomes larger, the amount charged in the dielectric portions 31*d* becomes larger. In order to increase the movement of the toner on the front surface of the developing roller, all one has to do is to make the toner circulation W active, which is illustrated in FIG. 21. With the above, the amount of charge in the dielectric portions 31*d* is increased, and minute closed electric fields are formed in the adjacent portions between the dielectric portions 31*d* and the conductive portion 31*c*1. Furthermore, the toner conveyed to the toner reservoir S close to the developing roller with the toner conveying member 33 receives gradient force and is drawn to and carried on the front surface of the developing roller.

Arrangement of Toner Conveying Member and Developing Blade

Figure 23:
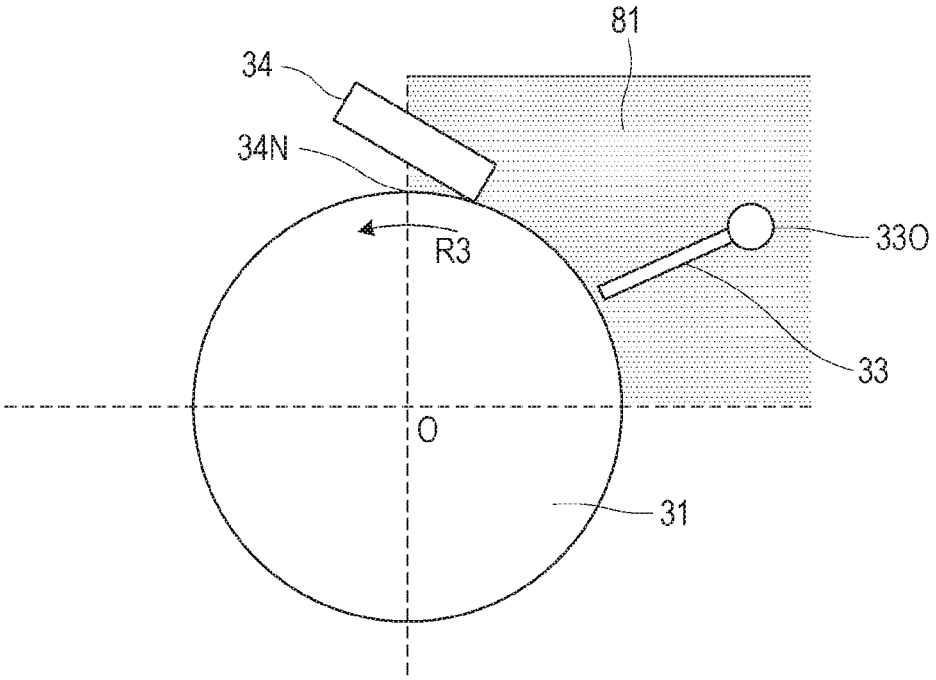
FIG. 23 is a diagram for describing an arrangement of the developing roller, the developing blade, and the toner conveying member.

Referring to FIGS. 21, 23, and 24A and 24*b*, the arrangement of the toner conveying member 33 and the developing blade 34 will be described. FIG. 23 is a schematic cross-sectional view of the configuration of the area surrounding the developing roller 21 of the developing apparatus 3 viewed in the rotational axis direction of the developing roller 31 while virtual straight lines that pass through a center O of the developing roller 31 and that extends in the gravitational direction and the horizontal direction are drawn such that the area surrounding the developing roller 31 is divided into four areas. Referring to the drawing, it is desirable that a rotation center 330 of the toner conveying member 33 and a position 34N where the developing blade 34 abuts against the developing roller 31 are in an area 81, which is the first quadrant, when the developing roller 31 is rotating in the R3-direction. In other words, the developing blade 34 abuts against the developing roller 31 at a portion above the rotation axis of the developing roller 31, and the rotating shaft of the toner conveying member 33 is positioned above the rotating axis of the developing roller 31. The position of the tip of the toner conveying member 33 that becomes closest to the developing roller 31 is positioned upstream of the abutment position of the developing blade 34 in the rotation direction of the developing roller 31. In other words, the developing blade and the conveying member are disposed to face each other so that the toner that was not able to go over the restriction position of the developing blade even when the developing roller was rotated is retained in a space in which the area between the position where the developing blade is in contact with the front surface of the developing roller and the position where the toner conveying member becomes the closest faces. The reason for the arrangement above is to effectively manifest the toner charge on the developing roller 31 with the toner circulation described above. The above point will be described in detail using FIG. 21.

FIG. 21 illustrates a state in which, in FIG. 23, the developing roller 31 rotates in the R3-direction, and the rotation center 33O of the toner conveying member 33 and the abutment position 34N between the developing blade 34 and the developing roller 31 are arranged in the area 81. In the above state, the developing blade 34 blocks the flow of the toner driven up along the developing roller 31 in the rotation direction and creates a flow of toner oriented towards the lower side, such that an ideal toner circulation W described above is formed. Furthermore, by stopping the toner conveying member 33 at a predetermined position, the toner reservoir S is formed in the space formed by the developing roller 31 and the toner conveying member 33. The toner accumulated above in the toner reservoir S can be coated on the developing roller 31.

Figure 24A:
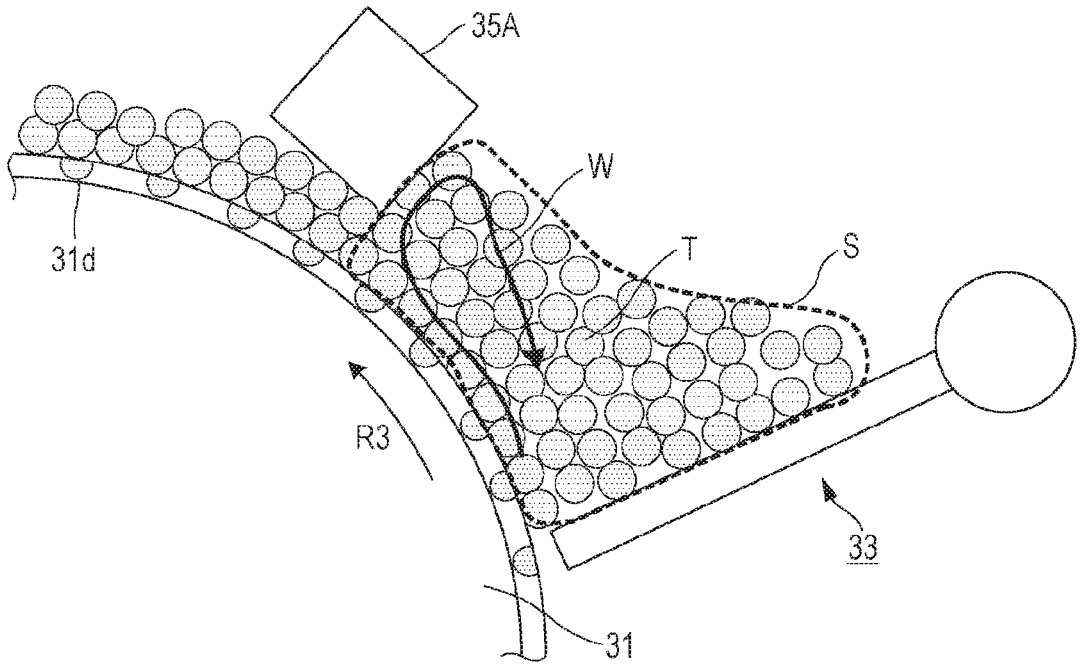
FIGS. 24A and 24B are diagrams for describing first and second modifications of the sixth exemplary embodiment.
Figure 24B:
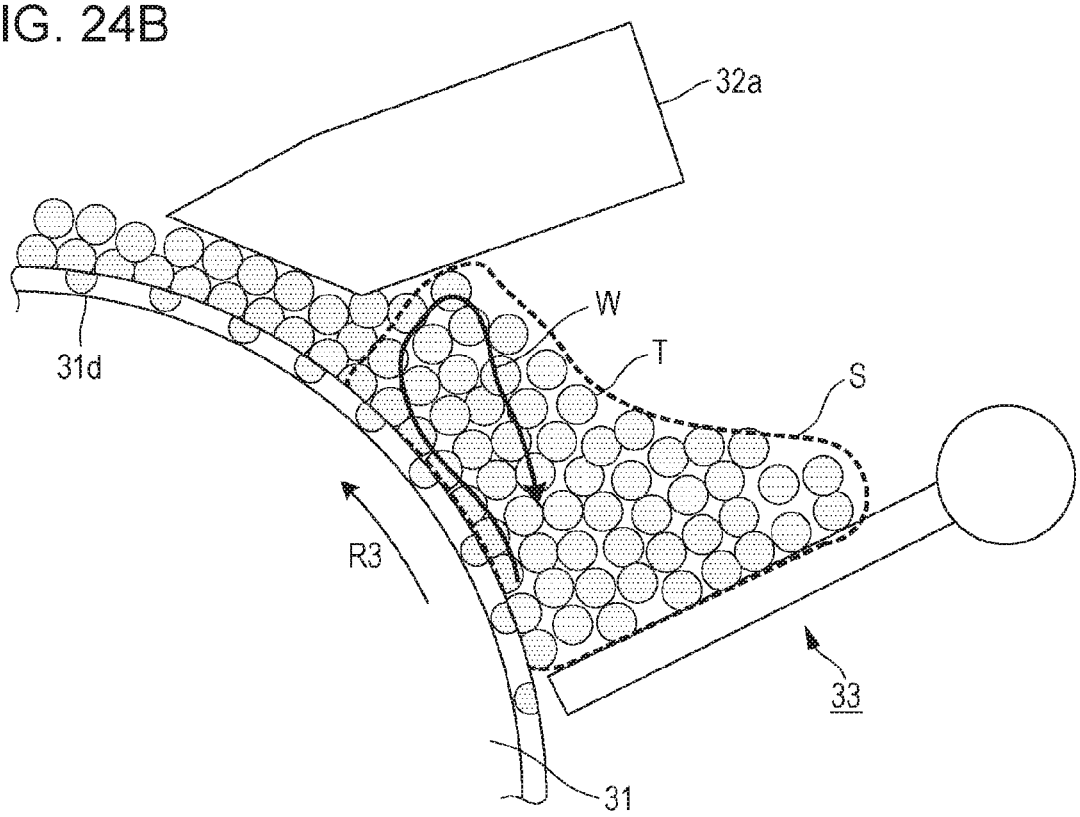

FIGS. 24A and 24B are schematic cross-sectional views for describing first and second modifications of the present exemplary embodiment. In the present exemplary embodiment, an example has been illustrated in which the developing blade 34 serving as a first restriction member is disposed so as to form an ideal toner circulation W; however, it does not necessarily have to be the developing blade 34. As illustrated in FIG. 24A, for example, a toner returning member 35A, serving as a first restriction member, that is a member different from the developing blade 34 may be disposed so as to partially stop the flow of the toner and form the toner circulation W (the first modification). Note that unlike the developing blade 34, toner returning member 35A does not abut against the developing roller 31, a gap configured to appropriately restrict the carried amount of toner is formed between the proximity portion that is at the closest position and the peripheral surface of the developing roller 31. Alternatively, as illustrated in FIG. 24B, a toner returning portion 32*a* formed as a portion of the development frame body 32 may stop a portion of the flow of the toner and form the toner circulation W. In other words, the development frame body 32 itself may have a function of a toner returner (the second modification). Note that in such a case, the developing blade 34 is disposed, in the rotation direction of the developing roller 31, downstream of the toner returning member 35A and the toner retuning portion 32*a*.

Detection of Environment Information and Operation of Second Restriction Member

A feature of the present exemplary embodiment is that an environment detection member capable of detecting temperature and humidity is mounted in the image forming main body and the stop position of the toner conveying member 33, serving as a second restriction member, is determined according to the output value.

A temperature-humidity environment sensor 78 illustrated in FIG. 19 constitutes an environment detection member that detects the environmental atmosphere surrounding the image forming apparatus main body (apparatus main body) 70. A control unit 77 is capable of controlling the voltages applied to the drive unit and the charging device and the light quantity output from the exposing device to predetermined values on the basis of the environmental atmosphere, such as the temperature and humidity detected by the temperature-humidity environment sensor 78 (the environment detection member).

Figure 25A:
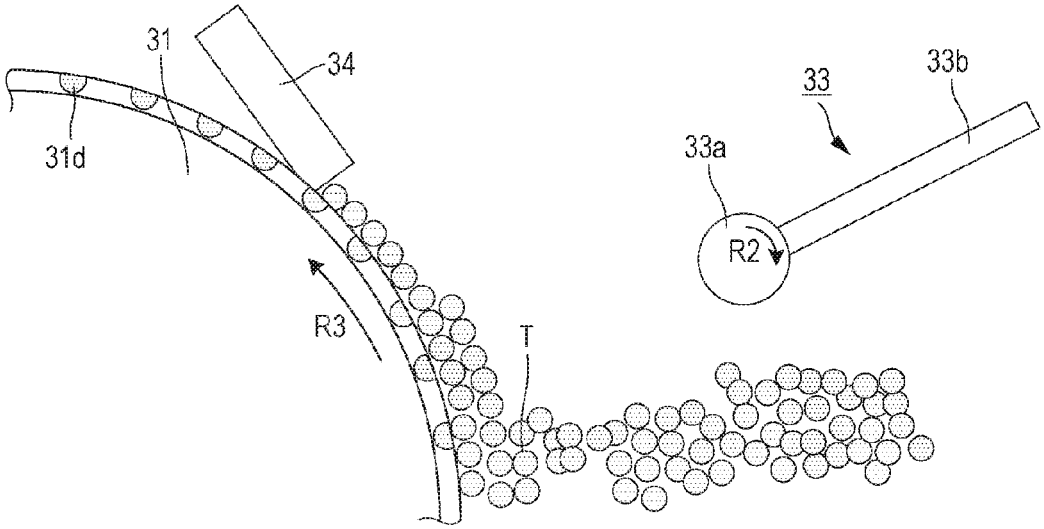
FIGS. 25A and 25B are diagrams for describing an operation of the toner conveying member.
Figure 25B:
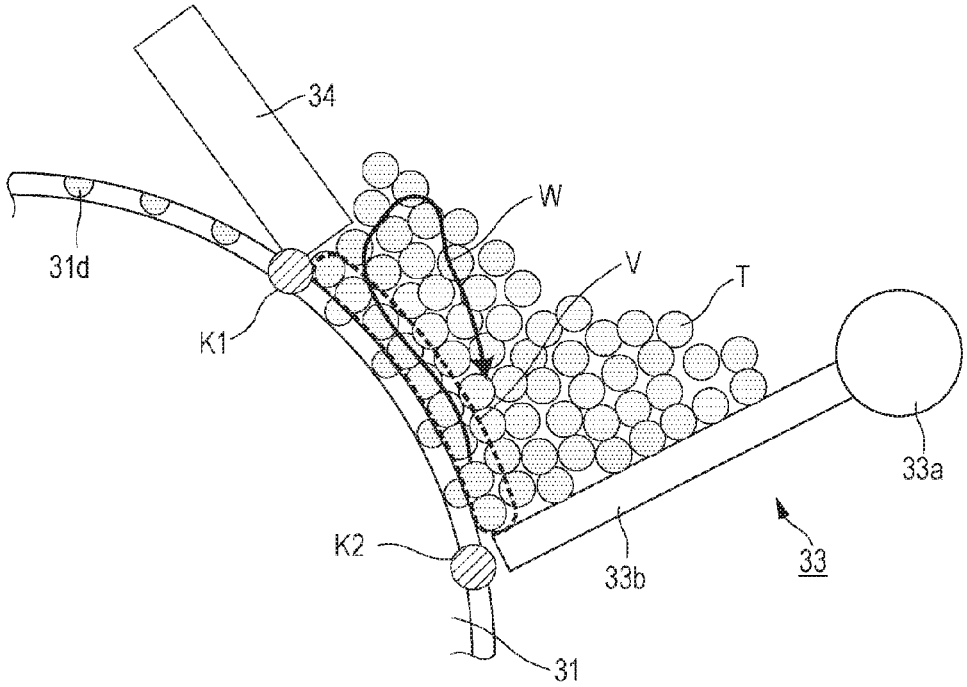

Referring to FIGS. 25A and 25B, operation of the toner conveying member 33 will be described. The toner conveying member 33 rotatable about the shaft portion 33*a* in the R2-direction is stopped during the image-forming period. Note that the "image-forming period" refers to a period when an electrostatic latent image formed on the front surface of the photosensitive drum 10 based on the image information sent from the image processing device (not shown) reaches a developing position and when the developing apparatus 3 is performing a development operation that turns the electrostatic latent image into a visible image. Furthermore, a "non-image-forming period" refers to a period when the photosensitive drum 10 and the developing apparatus 3 are driven by the drive member, while not turning the electrostatic latent image into a visible image. The reason for stopping the toner conveying member 33 at the above timing will be described below.

First, the toner conveying member 33 is stopped during the image-forming period to form the toner coating on the developing roller 31 in a stable manner. In order to form a stable toner coating, the toner circulation W and the toner reservoir S described above and illustrated in FIG. 21 need to be formed. Note that if the toner conveying member 33 were to be operated during the image-forming period, as illustrated in FIG. 25A, no toner circulation W nor the toner reservoir S will be formed when a tip of the toner conveying member 33 is at a position away from the developing roller 31. Accordingly, the toner conveying member 33 needs to be stopped in the vicinity of the developing roller 31 during image formation.

The factors that determine the toner coat amount on the developing roller before passing through the developing blade will be described next with reference to FIG. 25B. The toner coat amount before passing through the developing blade is determined by the following two factors.

(1) The larger the charge amount of the toner on the developing roller or the dielectric portions 31*d*, a larger gradient force is at work; accordingly, the toner coat amount increases.

(2) As a toner coating area V (the portion defined by the broken line in the drawing) that is an area in which the toner accumulated in the toner reservoir S formed with the toner conveying member, the developing roller, and the developing blade is in contact with the developing roller becomes larger, a toner suction opportunity increases; accordingly, the toner coat amount increases.

Note that the toner coating area V is an area that can be changed optionally by changing a distance (a gap) between K1 that is a point of contact (the proximate portion) between the developing blade 34 and the developing roller 31, and K2 that is a point of contact between an extended line of the toner conveying member 33 and the developing roller 31. Note that the extended line is a line obtained by extending a virtual line connecting a tip of a mixing portion (conveying portion) 33*b*, serving as a first end portion, and the shaft portion 33*a*, serving as a second end portion. Note that while the first position according to the present disclosure corresponds to K1 according to the present exemplary embodiment, the second position according to the present disclosure changes according to the position of the toner conveying member 33, and may coincide with K2 or may be, strictly speaking, a position different to K2. The aim of specifying such positions is to specify the area of the front surface of the developing roller 31 facing the toner retaining space, and in the present exemplary embodiment, description is given while deeming K2 to be at a position that is substantially the same as the second position of the present disclosure. The distance between K1 and K2 can be changed by changing the position of the portion of the developing roller 31 that is close to the toner conveying member 33 by rotating the toner conveying member 33. Furthermore, as described above, during the image forming operation, the rotation of the toner conveying member 33 is stopped; accordingly, the distance between K1 and K2 is maintained at a predetermined distance. Furthermore, the charge amount of the toner T or the dielectric portions 31*d* described in (1) above is known to vary under an environment during practical use. Specifically, the charge amount decreases as the environment becomes higher in temperature and higher in humidity, and increases as the environment becomes lower in temperature and lower in humidity. Accordingly, the toner coat amount also changes according to the environment in which the apparatus is used, and when on the high-temperature, high-humidity side, the coat amount decreases and when on the low-temperature, low-humidity side, the coat amount increases.

Figure 26A:
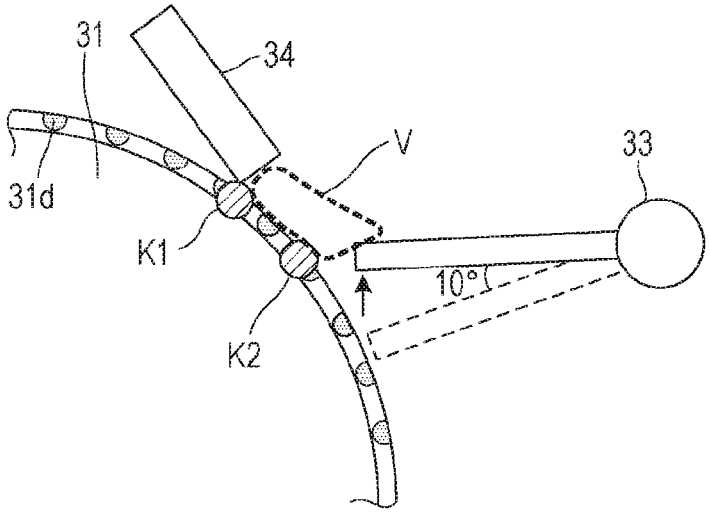
FIGS. 26A to 26C are diagrams for describing stop positions of the toner conveying member according to the sixth exemplary embodiment.
Figure 26B:
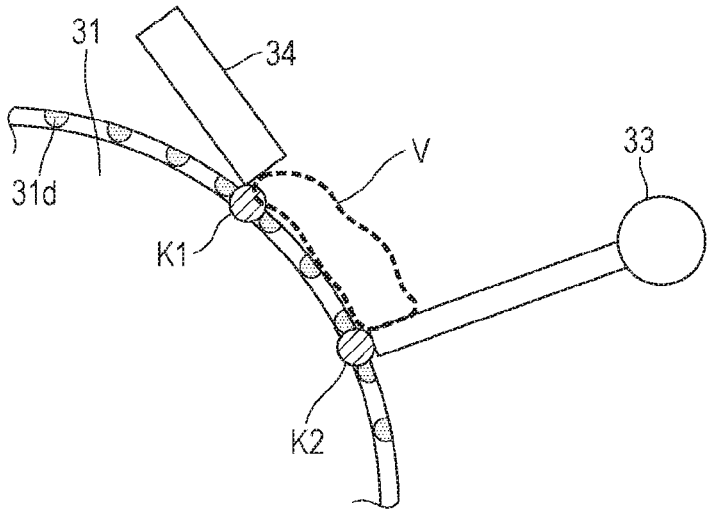
Figure 26C:
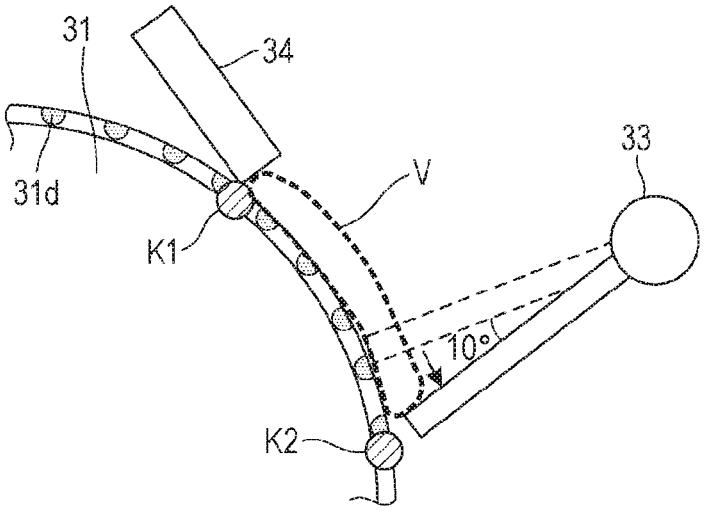

Accordingly, in the present exemplary embodiment, in accordance with a value of an absolute moisture content detected by the temperature-humidity environment sensor 78, the control unit 77 controls the drive unit, changes the stop position of the toner conveying member 33, and changes the toner coating area V. In other words, in a case in which the absolute moisture content acquired by the temperature and the humidity detected by the temperature-humidity environment sensor 78 is under a predetermined threshold (under a first threshold), the control unit 77, determining that it is a low temperature and low humidity environment, executes a control needed for a low temperature and low humidity environment described later. On the other hand, in a case in which the absolute moisture content acquired by the temperature-humidity environment sensor 78 is larger than a predetermined threshold (a second threshold), the control unit 77, determining that it is a high-temperature and high-humidity environment, executes a control needed for a high-temperature and high-humidity environment described later. In a case in which the absolute moisture content acquired with the temperature-humidity environment sensor 78 is equivalent to or higher than the first threshold and is equivalent to or lower than the second threshold, determining that it is a normal-temperature and normal-humidity environment, a state in which the toner coating area V suitable for the normal-temperature and normal-humidity environment is formed is maintained. With the above, the toner coat amount can be substantially uniformized regardless of the change in the environment. Tables 1 and 2 below are experimental results in which the toner coat amount before passing through the developing blade had been measured in a case in which the stop position of the toner conveying member was changed in accordance with the absolute moisture content and in a case in which the stop position of the toner conveying member was not changed. FIGS. 26A to 26C illustrate the stop position of the toner conveying member 33 at each state.

In the present exemplary embodiment, the environment in which the absolute moisture content is from 0.5 g/m$^3$ or higher to 15.0 g/m$^3$ or lower is referred to as the normal-temperature and normal-humidity environment. In such a case, as illustrated in FIG. 26B, the rotation of the toner conveying member 33 is stopped at a rotational phase in which the tip of the toner conveying member 33 is proximate to the developing roller 31. In the above case, the distance along the peripheral surface of the developing roller 31 between K1 and K2 (the distance in the rotation direction of the developing roller 31) corresponds to the first distance of the present disclosure, and the rotational phase of the toner conveying member 33 in such a case corresponds to a first phase. The threshold (a first threshold) of the absolute moisture content for determining that the environment is a low-temperature and low-humidity environment is set at 0.5 g/m$^3$, and in a case in which the detection value of the temperature-humidity environment sensor 78 is lower than 0.5 g/m$^3$, the control unit 77 determines that the device environment is the low-temperature and low-humidity environment. In such a case, as illustrated in FIG. 26A, the rotation of the toner mixing member (conveying member) 33 is stopped when the angle of the toner mixing member 33 is at a phase 10° downstream from the phase illustrated in FIG. 26B in the rotation direction. In the above case, the distance along the peripheral surface of the developing roller 31 between K1 and K2 (the distance in the rotation direction of the developing roller 31) corresponds to a second distance of the present disclosure, and the rotational phase of the toner conveying member 33 in such a case corresponds to a second phase. Furthermore, the threshold (a second threshold) of the absolute moisture content for determining that the environment is a high-temperature and high-humidity environment is set at 15.0 g/m$^3$, and in a case in which the detection value of the temperature-humidity environment sensor 78 is higher than 15.0 g/m$^3$, the control unit 77 determines that the device environment is the high-temperature and high-humidity environment. In such a case, as illustrated in FIG. 26C, the rotation of the toner conveying member 33 is stopped when the angle of the toner mixing member 33 is at a phase 10° upstream from the phase illustrated in FIG. 26B in the rotation direction. In the above case, the distance along the peripheral surface of the developing roller 31 between K1 and K3 (the distance in the rotation direction of the developing roller 31) corresponds to a third distance of the present disclosure, and the rotational phase of the toner conveying member 33 in such a case corresponds to a third phase. Note that the boundaries of the absolute moisture contents that affect the toner coat amount are not limited to the above boundaries and are appropriately changed in accordance with, for example, the material of the toner and the configuration of the drive.

Sixth Exemplary Embodiment

TABLE 1

| ABSOLUTE MOISTURE CONTENT_g/m$^3$ | 2 | 10 | 20 |
|---|---|---|---|
| STOP POSITION OF TONER CONVEYING MEMBER | FIG. 26A | FIG. 26B | FIG. 26C |
| TONER COAT AMOUNT_mg/cm$^2$ BEFORE PASSING THROUGH DEVELOPING BLADE | 1.2 | 1.0 | 1.0 |

* Stop position

FIG. 26A: A position where the tip of the toner conveying member is 10° downstream in the rotation direction with respect to the position in FIG. 26B FIG. 26B: A position where the tip of the toner conveying member is proximate to the developing roller FIG. 26C: A position where the tip of the toner conveying member is 10° upstream in the rotation direction with respect to the position in FIG. 26B

FIRST COMPARATIVE EXAMPLE

TABLE 2

| ABSOLUTE MOISTURE CONTENT_g/m$^3$ | 2 | 10 | 20 |
|---|---|---|---|
| STOP POSITION OF TONER CONVEYING MEMBER | FIG. 26C | FIG. 26C | FIG. 26C |
| TONER COAT AMOUNT_mg/cm$^2$ BEFORE PASSING THROUGH DEVELOPING BLADE | 2.1 | 1.4 | 1.0 |

As illustrated above, a developing apparatus that is capable of coating the appropriate amount of toner even when there is a change in the environment can be provided by controlling the stop position of the toner conveying member according to the detection result of the environment detection member. In the above table, each of the stop positions of the toner conveying member is varied by 10° with respect to the position proximate to the developing roller; however, the positions may be set in a more minute manner in accordance with the absolute moisture content obtained with the environment sensor. In such a case, for example, the stop positions corresponding to the absolute moisture contents are set in a minute manner in a recording memory of the image forming apparatus main body, and the value obtained with the environment sensor is matched with the stored stop positions and the toner conveying member is stopped at the corresponding stop position. Alternatively, the toner conveying member may be stopped at a position obtained by performing linear interpolation on the three stop positions in the above table and the absolute moisture content.

Furthermore, in the present exemplary embodiment, the rotation and stoppage of the toner conveying member synchronizes with the separation and abutment between the photosensitive drum 10 and the developing apparatus 3. In other words, during the abutment (during the image-forming period), the rotation gear of the toner conveying member is detached from the drive unit and the toner conveying member is stopped, and during the separation (during the non-image-forming period), the rotation gear of the toner conveying member and the drive unit are meshed to each other and the toner conveying member is operated. Accordingly, by controlling the separation time of the non-image-forming period, the control unit inside the image forming body is capable of controlling the stop position of the toner conveying member such that the toner conveying member can always be stopped at the same position during the image-forming period.

Third Modification

Figure 27A:
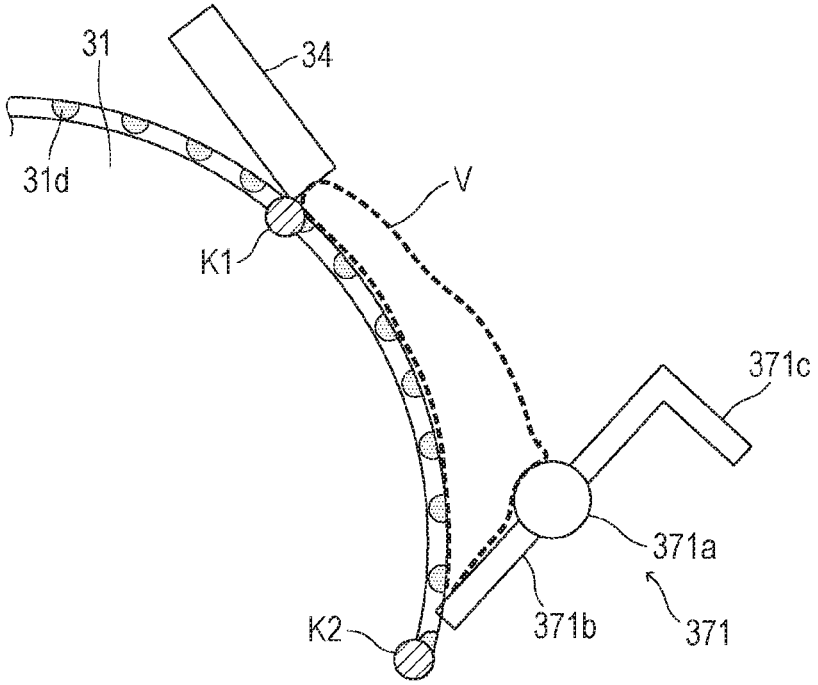
FIGS. 27A and 27B are diagrams for describing a third modification of the sixth exemplary embodiment.
Figure 27B:
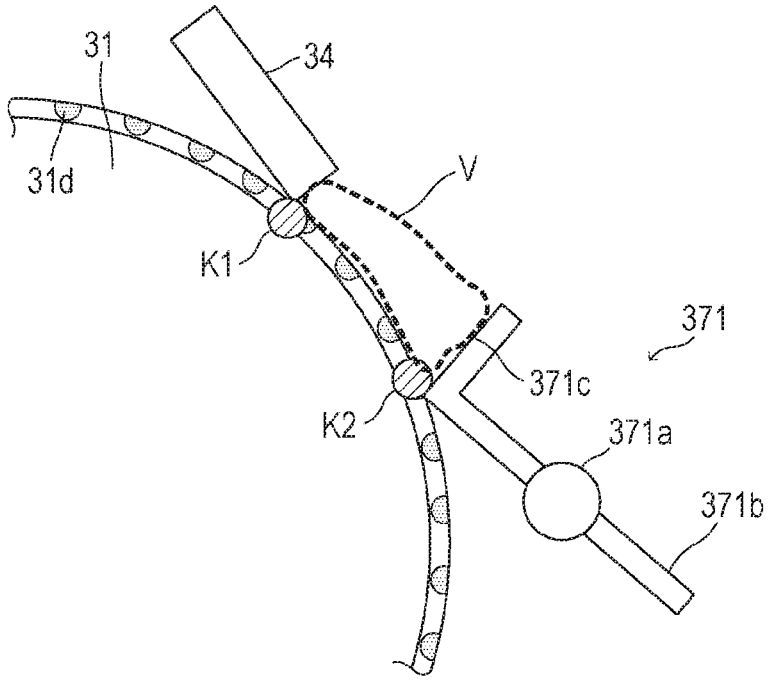

FIGS. 27A and 27B are schematic cross-sectional views of a developing apparatus according to a third modification of the sixth exemplary embodiment. In the present exemplary embodiment, the toner coating area V is varied by having the toner conveying member 33 function as the second restriction member as well; however, as illustrated in FIGS. 27A and 27B, a member that is separate from the toner conveying member 33 may be provided as the second restriction member. A second restriction member 371 according to the present modification is a member that is rotatably provided inside the toner accommodation portion of the development frame body 32. The second restriction member 371 includes a shaft portion 371*a* that is a rotating shaft, a first restriction portion 371*b* that forms a large toner coating area V illustrated in FIG. 27A, and a second restriction portion 371*c* that forms a small toner coating area illustrated in FIG. 27B. In such a configuration as well, the position of K2 can be changed and the toner coating area V can be varied by pivoting the pivotal second restriction member 371.

Fourth Modification

Figure 32A:
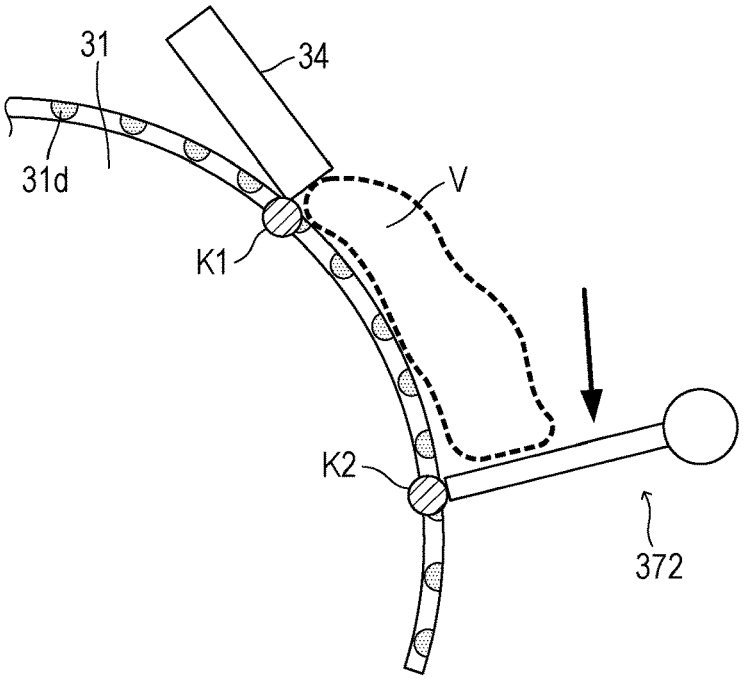
FIGS. 32A and 32B are diagrams for describing a fourth modification of the sixth exemplary embodiment.
Figure 32B:
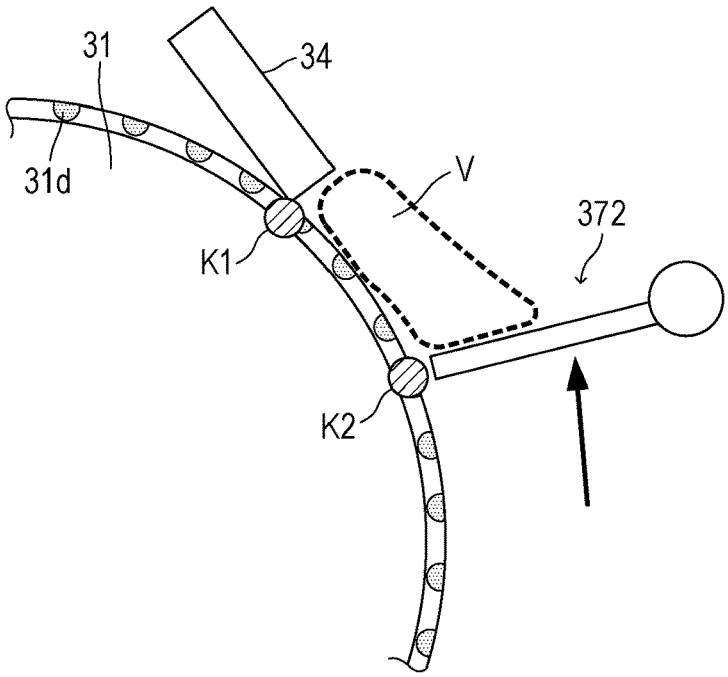

FIGS. 32A and 32B are schematic cross-sectional views of a developing apparatus according to a fourth modification of the sixth exemplary embodiment. In the present exemplary embodiment, the toner coating area V is changed by rotating the toner conveying member 33; however, the toner coating area V may be changed through a displacement other than a rotation. As illustrated in FIGS. 32A and 32B, a second restriction member 372 is configured to move up and down inside the toner accommodating portion of the development frame body 32 without changing the angle. FIG. 32A illustrates a case in which the second restriction member 372 is in a first position that forms a large toner coating area V (a first distance), and FIG. 32B illustrates a case in which the second restriction member 372 is in a second position that forms a small toner coating area V (a second distance). As described above, the toner coating area V may be varied by a displacement other than a rotation of the second restriction member. Note that in the present configuration, the inclined state of the inclined surface of the second restriction member 372, in other words, the inclined state of the inclined surface that extends downwards from a position that is above K2 and that is away from the developing roller 31 to K2, can be maintained while being displaced to change the position of K2. Accordingly, regardless of the position of K2, the toner circulation W can be formed in a suitable manner.

Fifth Modification

Figure 33A:
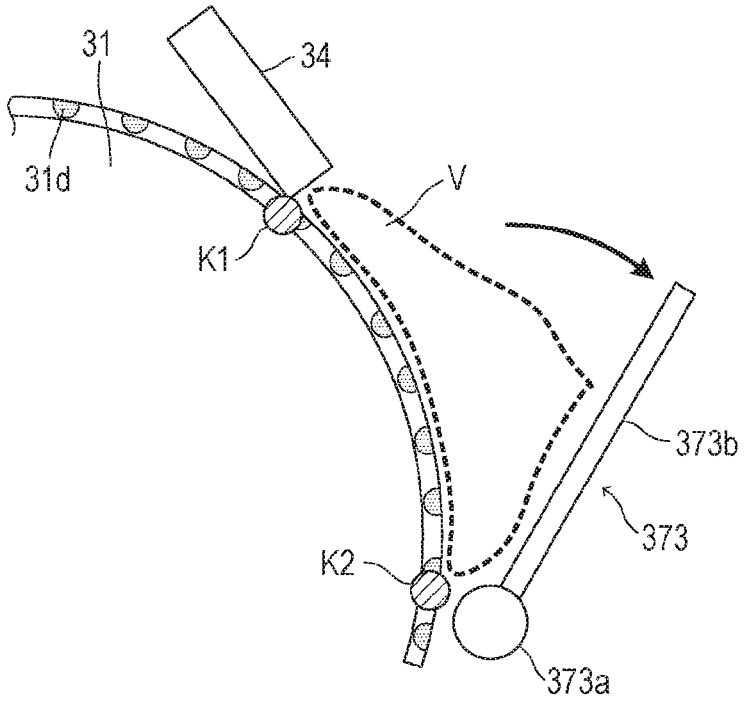
FIGS. 33A and 33B are diagrams for describing a fifth modification of the sixth exemplary embodiment.
Figure 33B:
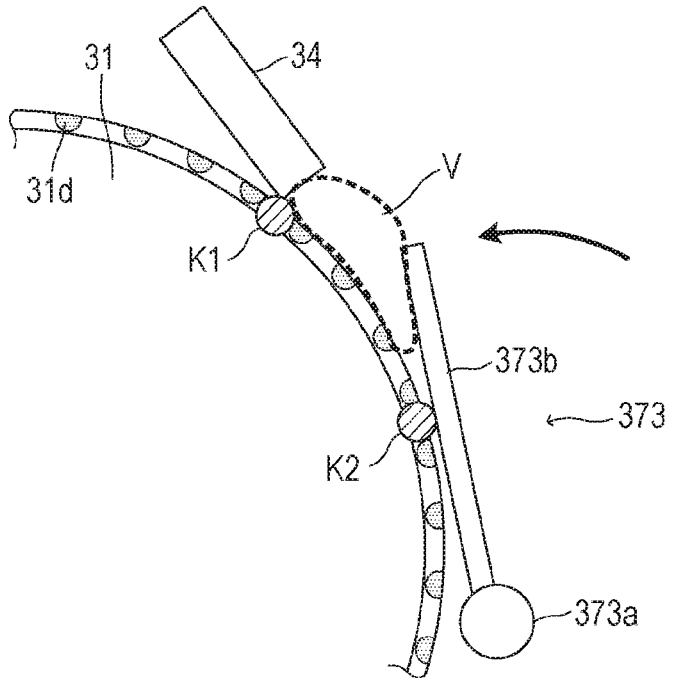

FIGS. 33A and 33B are schematic cross-sectional views of a developing apparatus according to a fifth modification of the sixth exemplary embodiment. As a member that is separate from the toner conveying member 33 and that serves as the second restriction member, a second restriction member 373 as illustrated in FIGS. 33A and 33B may be provided. The second restriction member 373 includes a shaft portion 373*a* that is disposed in a rotational manner close to the front surface of the developing roller 31, and a sheet-like portion 373*b* that extends upwards from the shaft portion 373*a*. FIG. 32A illustrates a case in which the second restriction member 373 is at a first phase that forms a large toner coating area V (the first distance). The sheet-like portion 373*b* moving away from the front surface of the developing roller 31 is opened, and with such an arrangement, the shaft portion 373*a* becomes the closest to the front surface of the developing roller 31. FIG. 32B illustrates a case in which the second restriction member 373 is at a second phase that forms a small toner coating area V (the second distance). The sheet-like portion 373*b* moving towards the front surface of the developing roller 31 makes the toner coating area V smaller.

Sixth Modification

Figure 34:
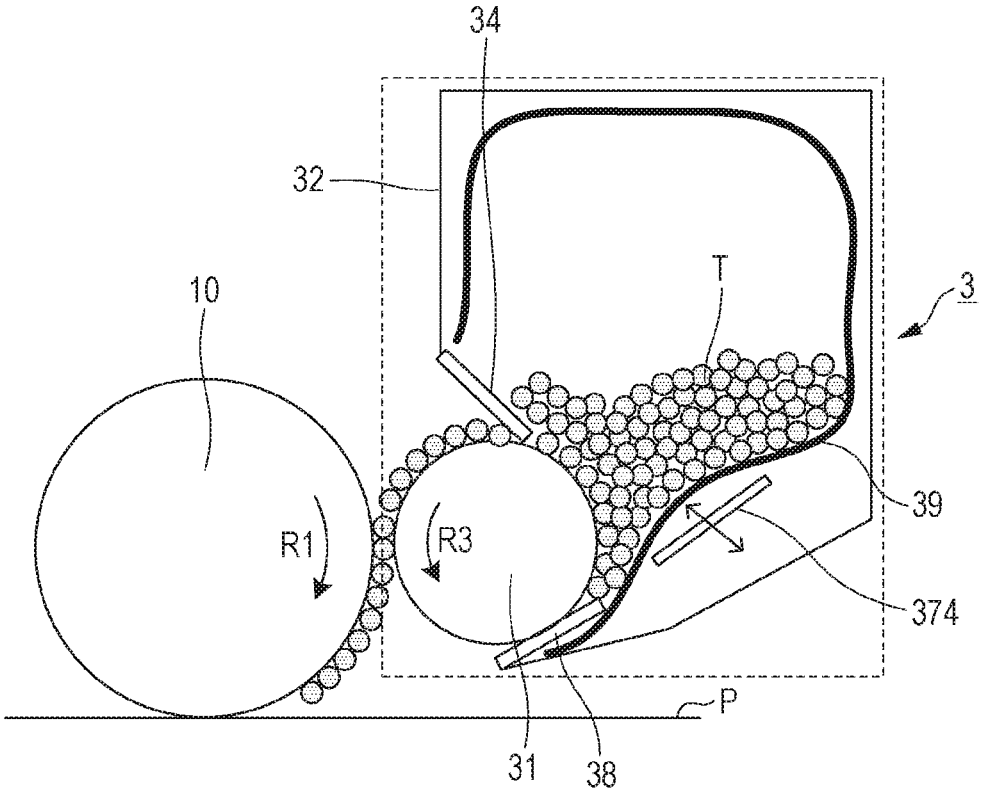
FIG. 34 is a schematic cross-sectional view of a developing apparatus of a sixth modification of the sixth exemplary embodiment.

FIG. 34 is a schematic cross-sectional view illustrating a schematic configuration of a developing apparatus 3 according to a sixth modification of the sixth exemplary embodiment. In the development apparatus 3 according to the sixth modification, the toner is not directly accommodated inside the development frame body 32 but is accommodated inside a flexible bag like container 39 provided in the development frame body 32. Furthermore, the development apparatus 3 includes a movable member 374 that is provided so as to be movable inside the development frame body 32 and outside of the flexible member. When moving inside the development frame body 32, the movable member 374 abuts against the flexible container 39, and by changing the abutting portion, the flexible container 39 can be deformed. The feature of the present modification is that by deforming the flexible container 39 with the movement of the movable member 374, the position and the range of a proximity portion of the flexible container 39 that is close to the developing roller 31 are changed.

Figure 35A:
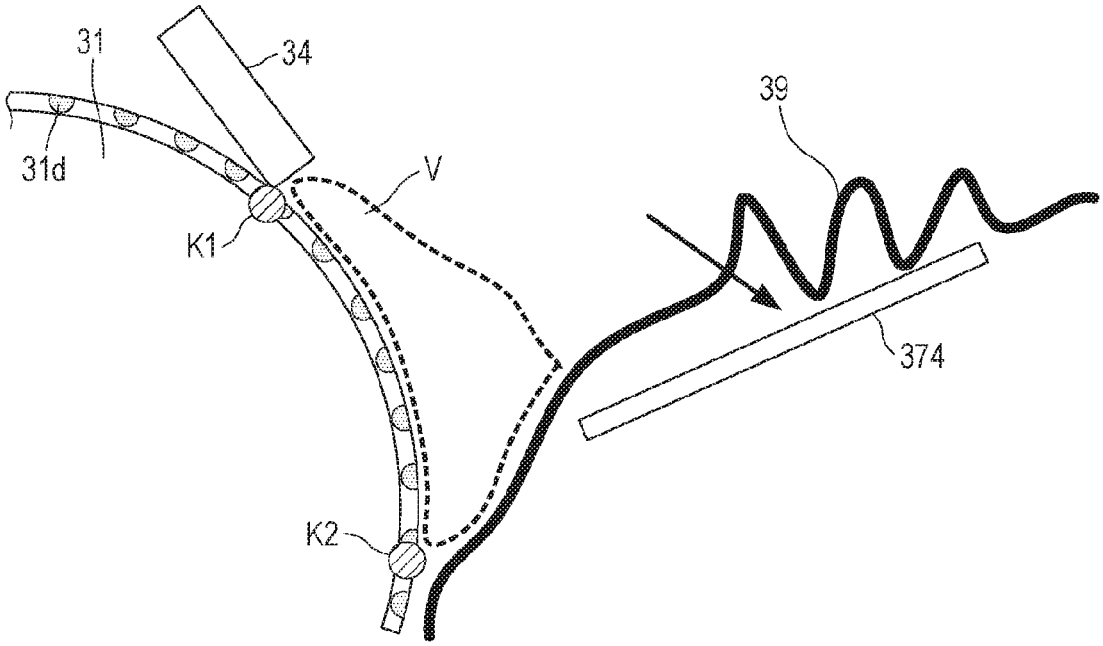
FIGS. 35A and 35B are diagrams for describing the sixth modification of the sixth exemplary embodiment.
Figure 35B:
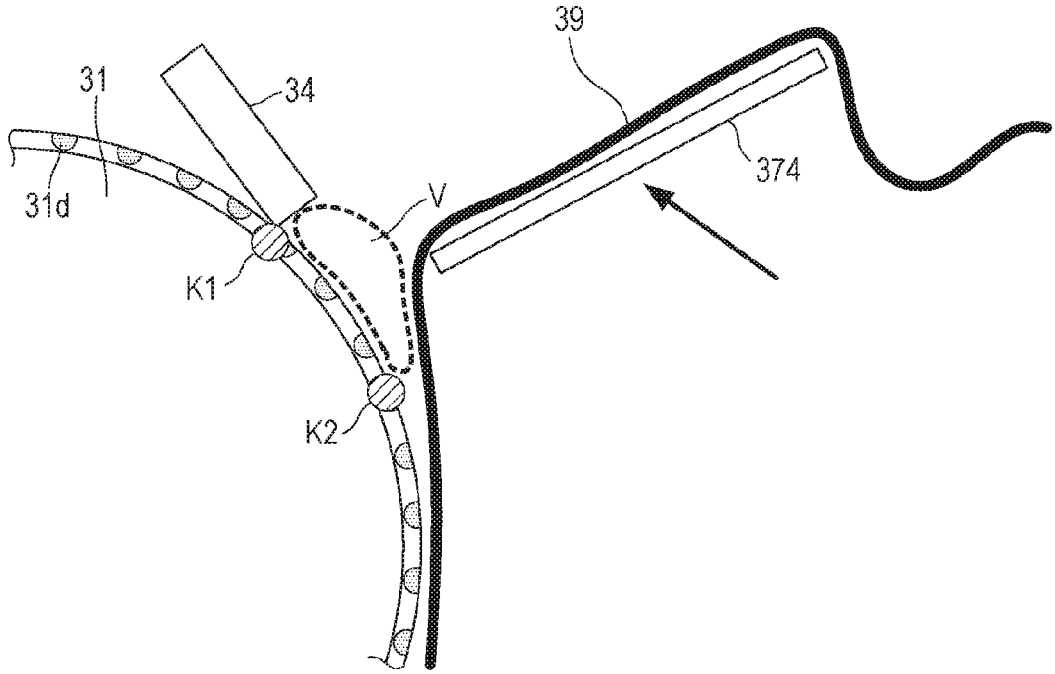

FIGS. 35A and 35B are schematic cross-sectional views of a developing apparatus according to a sixth modification of the sixth exemplary embodiment, and are drawings to illustrate the manner in which the shape of the flexible container 39 changes.

FIG. 35A illustrates a shape of the flexible container 39 when a large toner coating area V (a first distance) is formed, and the movable member 374 is at a retracted position that does not apply any contact pressure to the flexible container 39. In other words, the flexible container 39 is not in a state in which the shape thereof is restricted by the movable member 374 (a non-restricted state). Accordingly, an inner wall surface of the flexible container 39 is far apart from the front surface of the developing roller 31 such that a large toner coating area V is formed.

FIG. 35B illustrates a shape of the flexible container 39 when a small toner coating area V (a second distance) is formed. In other words, in order to reduce the toner coating area V, the movable member 374 moves to a predetermined abutment position, applies a predetermined contact pressure to the flexible container 39, and deforms the flexible container 39 such that the inner wall surface of the flexible container 39 approaches the front surface of the developing roller 31. The flexible container 39 is in a state in which the deformation described above is restricted at the portion abutted against the movable member 374 (a restricted state).

Seventh Exemplary Embodiment

Figure 28:
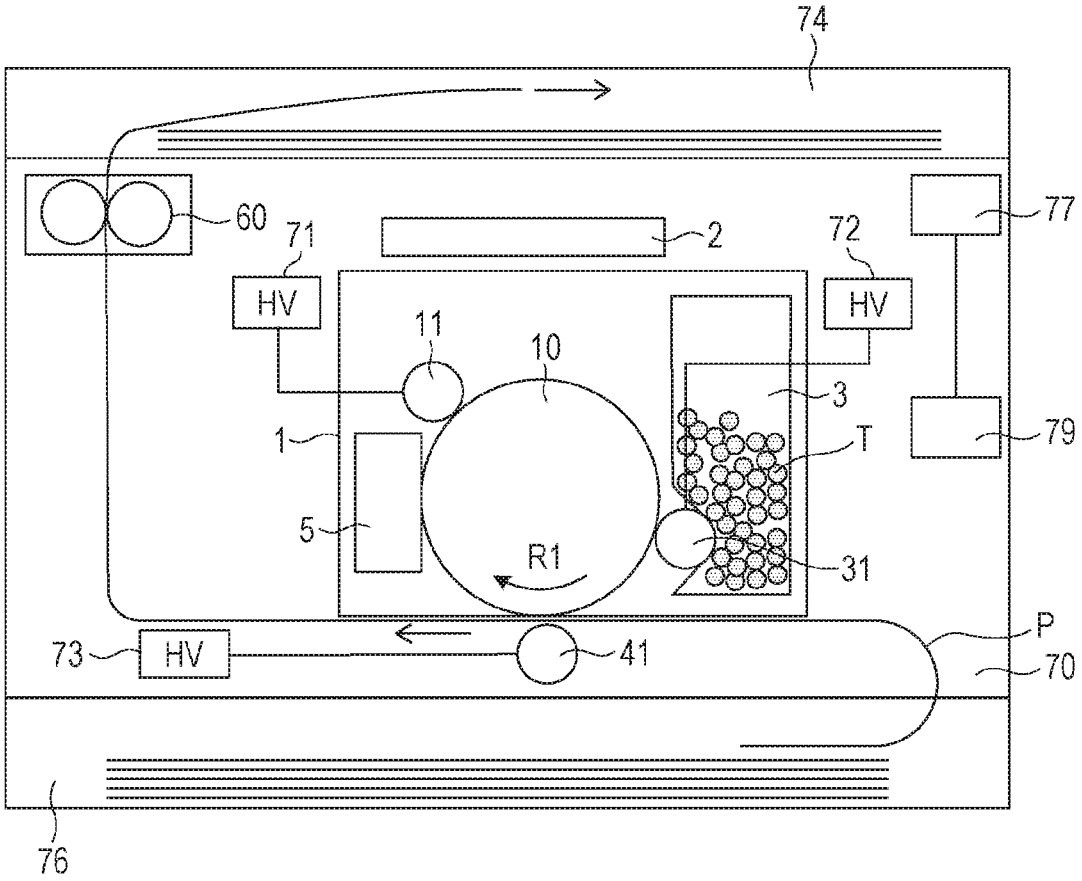
FIG. 28 is a schematic cross-sectional view of an image forming apparatus of a seventh exemplary embodiment.
Figure 29A:
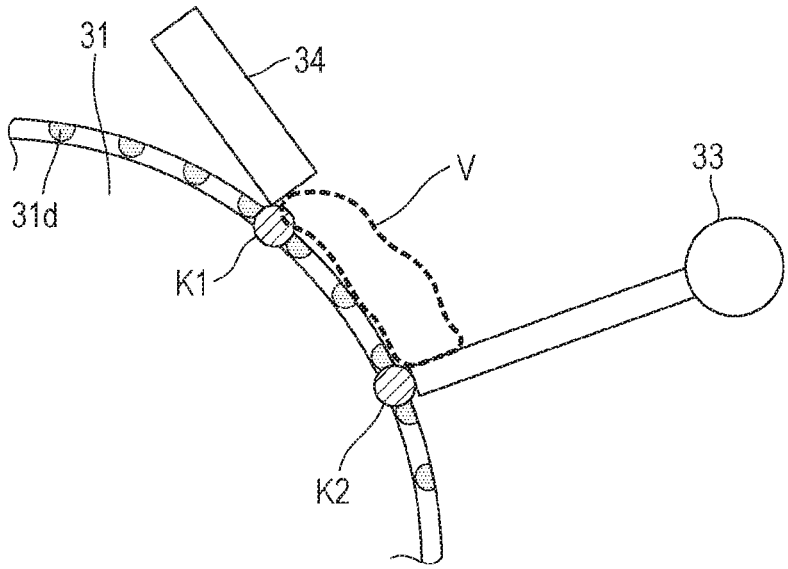
FIGS. 29A and 29B are diagrams for describing stop positions of a toner conveying member according to the seventh exemplary embodiment.
Figure 29B:
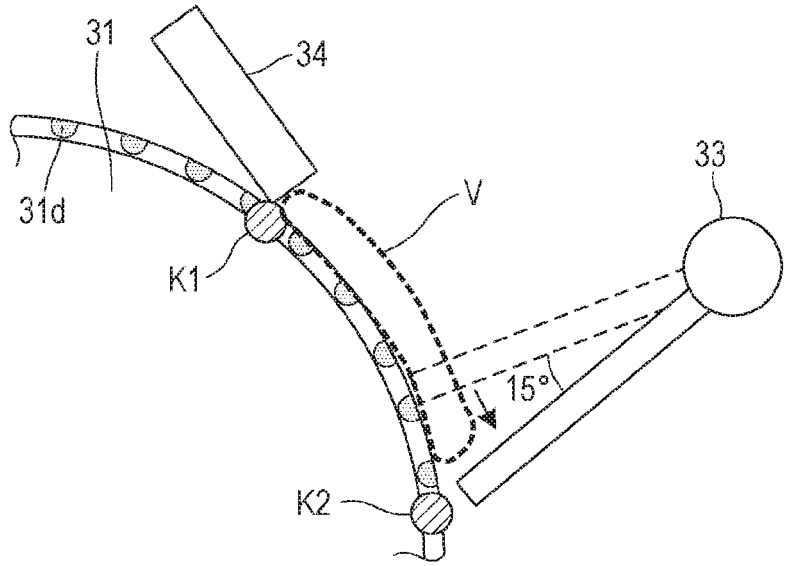

Referring to FIGS. 28, 29A, and 29B, a seventh exemplary embodiment of the present disclosure will be described. A feature of the seventh exemplary embodiment is that a toner state detecting member that is capable of detecting the state of the toner is mounted in the image forming apparatus main body, and the stop position of the second restriction member is determined in accordance with the output value. In the present configuration, the state of the toner is defined by the total number of printed sheets. In the seventh exemplary embodiment, components that are the same as those of the sixth exemplary embodiment are attached with the same reference numerals and repeated description will be omitted. Matters that are not described in the seventh exemplary embodiment are similar to those of the sixth exemplary embodiment.

Toner State Detecting Member

FIG. 28 is a schematic cross-sectional view illustrating a schematic configuration of an image forming apparatus according to the present exemplary embodiment. The image forming apparatus according to the present exemplary embodiment includes a sheet counter 79 that counts the number of sheets that has been printed (the number of times image has been formed), which is an example of a member that detects the state of the toner. In other words, the control unit 77 determines the state of the toner based on the count number of the sheet counter 79, controls the drive unit in accordance with the state of the toner and changes the stop position of the toner conveying member 33, and varies the toner coating area V. The sheet counter 79 counts the cumulative number of printed sheets, and successively counts the number of sheets at the same time as the printing.

As the developing apparatus repeats the image forming operation, the toner that remain inside the development frame body 32 without being used for the development of the latent images becomes deteriorated due to, for example, rubbing between the toner themselves, and being rubbed against the toner conveying member 33 and the developing blade 34. When the deterioration of the toner is accelerated, the toner drawing effect created by the minute closed electric fields on the front surface of the developing roller 31 decreases, and a sufficient toner coat amount may not be obtained in the latter half of the life time of the developing apparatus. Lack of toner coat amount may lead to a creation of a defective image. In the present exemplary embodiment, when the number of sheets printed (the number in which image formation has been executed), which can determine that the deterioration of toner has been accelerated, reaches a predetermined number, the toner suction opportunity is increased by enlarging the toner coating area V such that insufficiency in toner coat amount does not occur. FIG. 29A illustrates a case in which a toner restriction member 33 is in a first position that forms a normal toner coating area V (a first distance), and FIG. 29B illustrates a case in which the toner restriction member 33 is in a third position that forms a large toner coating area V (a third distance). In other words, when the count number of the sheet counter 79 is under a predetermined threshold, the control unit 77 determines that the effect of the deterioration of the toner is still small and stops the toner mixing member 33 in a rotational phase (a first phase) that forms a normal toner coating area V. The threshold of the number of sheets in the present exemplary embodiment is 6000 sheets. On the other hand, when the count number is equivalent to or larger than the predetermined threshold, in other words, when over 6000 sheets, it is determined that the deterioration of toner is accelerated, and the toner mixing member 33 is stopped in a rotational phase (a third phase) in which an enlarged toner coating area V is formed. Tables 3 and 4 below are experimental results in which the toner coat amount before passing through the developing blade had been measured in a case in which the stop position of the toner conveying member was changed in accordance with the number of printed sheets and in a case in which the stop position of the toner conveying member was not changed.

Seventh Exemplary Embodiment

TABLE 3

| PRINTED NUMBER OF SHEETS | 2000 | 4000 | 6000 |
|---|---|---|---|
| TONER COAT AMOUNT_mg/cm$^2$ BEFORE PASSING THROUGH DEVELOPING BLADE | 1.4 | 1.4 | 1.4 |
| STOP POSITION OF TONER CONVEYING MEMBER | FIG. 29A | FIG. 29A | FIG. 29B |

* Stop position

FIG. 29A: A position where the tip of the toner conveying member is proximate to the developing roller FIG. 29B: A position where the tip of the toner conveying member is 15° upstream in the rotation direction with respect to the position in FIG. 29A

SECOND COMPARATIVE EXAMPLE

TABLE 4

| PRINTED NUMBER OF SHEETS | 2000 | 4000 | 6000 |
|---|---|---|---|
| TONER COAT AMOUNT_mg/cm$^2$ BEFORE PASSING THROUGH DEVELOPING BLADE | 1.4 | 1.4 | 1.0 |
| STOP POSITION OF TONER CONVEYING MEMBER | FIG. 29A | FIG. 29A | FIG. 29A |

As illustrated above, when a certain number of sheets are printed, the state of the toner disadvantageously changes from the new state, and the toner circulation W illustrated in FIG. 21 becomes disadvantageously small. In such a case, the desired amount of toner cannot be coated and, as a result, the development coat amount becomes smaller than the coat amount when the toner was in a new state. Accordingly, by controlling the stop position of the toner conveying member according to the detection result of the toner state detecting member, it will be possible to coat the appropriate amount of toner even when there is a change in the state of the toner. In the present exemplary embodiment, the state of the toner is detected by using a sheet counter; however, a member that measures the amount of toner included in the developing apparatus may be used, and in accordance with the included toner amount, the stop position may be changed. Furthermore, by performing the present control together with the control based on the environment detection of the sixth exemplary embodiment, a more stable toner coating can be formed.

Eighth Exemplary Embodiment

Referring to FIGS. 26A to 26C, and 30A and 30B, an eighth exemplary embodiment of the present disclosure will be described. A feature of the eighth exemplary embodiment is that a coated toner detecting member that is capable of detecting the state of the coated toner on the developing roller 31 is mounted in the image forming apparatus main body, and the stop position of the second restriction member is determined in accordance with the output value. In the eighth exemplary embodiment, components that are the same as those of the sixth exemplary embodiment are attached with the same reference numerals and repeated description will be omitted. Matters that are not described in the eighth exemplary embodiment are similar to those of the sixth exemplary embodiment.

Toner Coated State Detecting Member

Figure 30A:
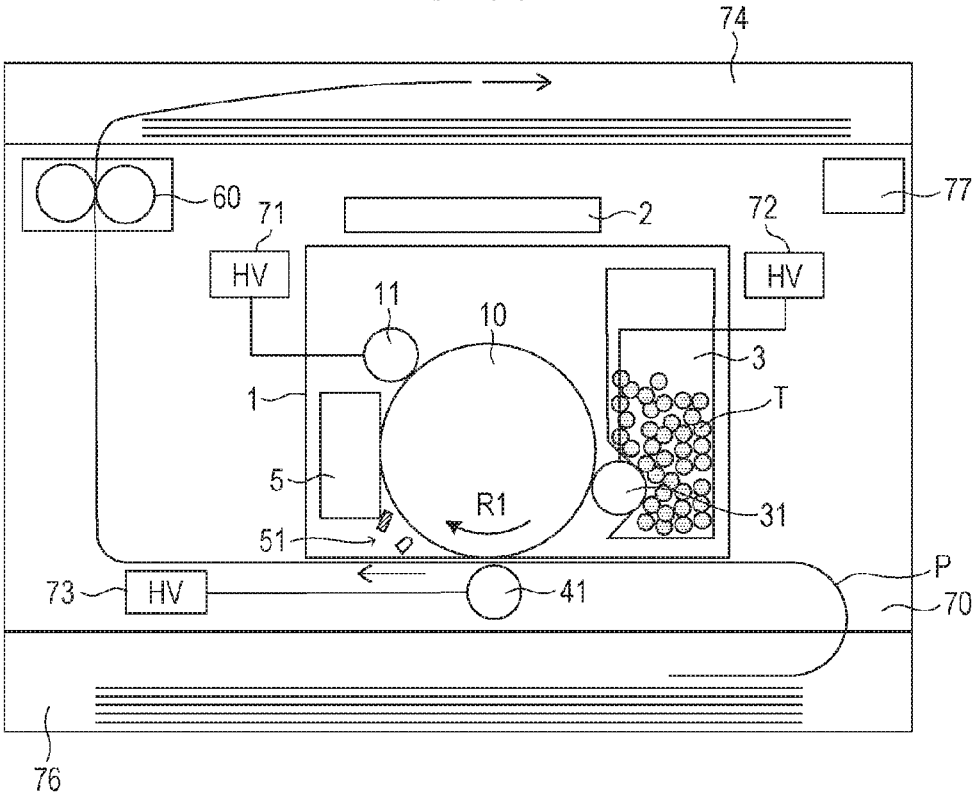
FIGS. 30A and 30B are diagrams for describing the image forming apparatus of the seventh exemplary embodiment.
Figure 30B:
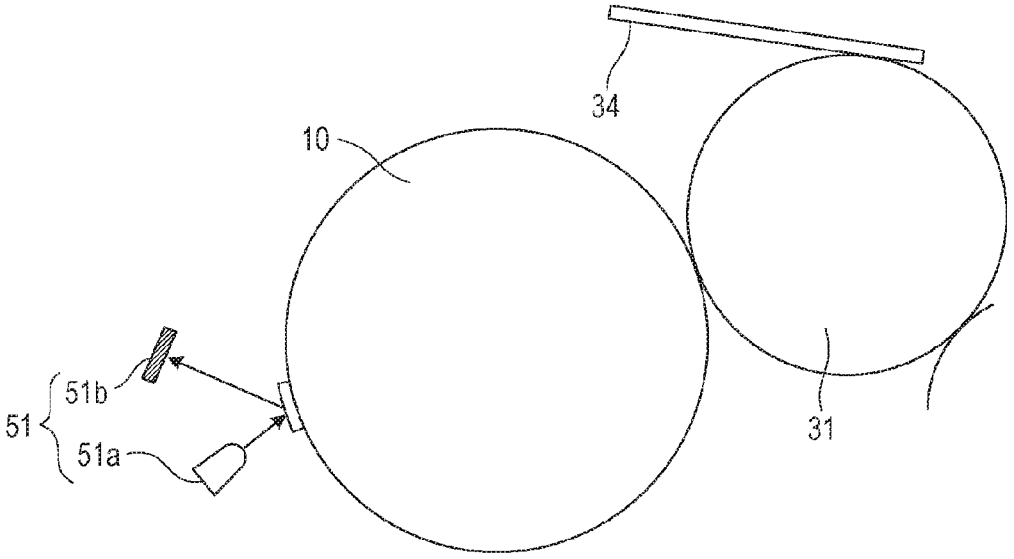

FIGS. 30A and 30B are schematic diagrams for describing a configuration of an image forming apparatus according to an eighth exemplary embodiment of the present disclosure. FIG. 30A is a schematic cross-sectional view of the image forming apparatus according to the present exemplary embodiment, and FIG. 30B is a diagram for describing a configuration of a coated toner detecting member according to the present exemplary embodiment. The image forming apparatus according to the present exemplary embodiment uses, as a member that detects the toner coating, a member that detects a reflection density of the toner carried on the photosensitive drum 10 in order to achieve detection of the toner coat amount. As illustrated in FIG. 30B, a concentration detecting sensor 51 including a light source 51*a* and a photo-sensor 51*b* is disposed in the vicinity of the photosensitive drum 10.

Figure 31:
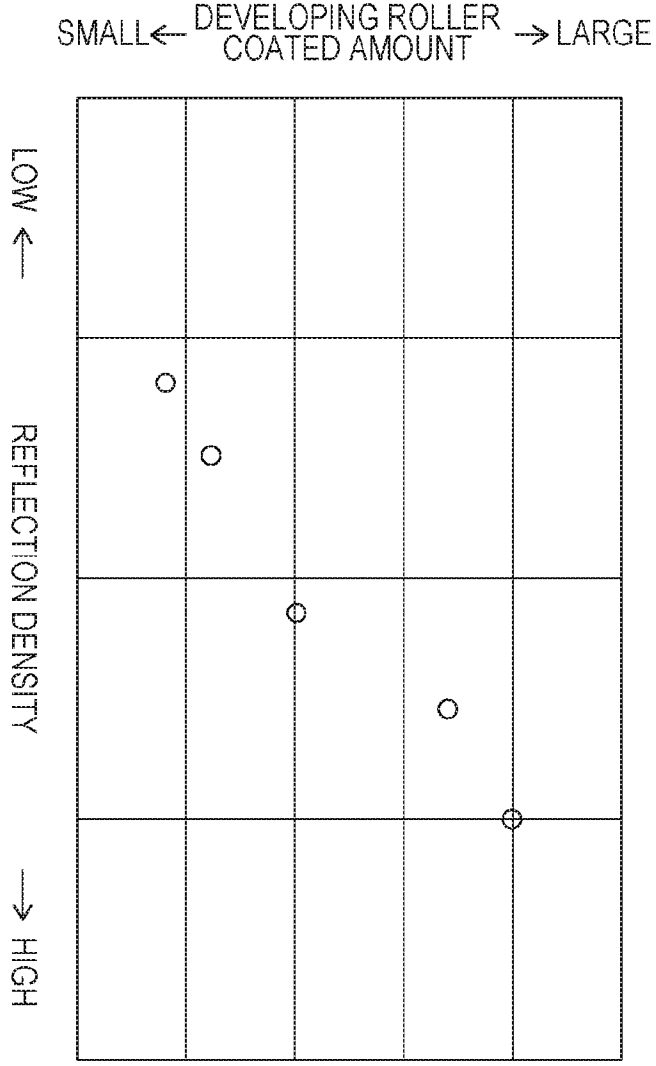
FIG. 31 is a relationship diagram between a reflection density of the toner and a coated amount on the developing roller.

In the present exemplary embodiment, a detecting operation of the toner coat amount is executed when the power of the image forming apparatus is turned on. In performing the detection of the toner coat amount, in other words, in detecting the applied amount of toner per unit area, a patch of solid image of 5 mm by 5 mm is developed on the photosensitive drum 10 as an image for detection to detect the reflection density of the toner. The toner coat amount on the developing roller 31 is measured by reading the solid image with the concentration detecting sensor 51 disposed in the vicinity of the photosensitive drum 10. The detected reflection density obtained above is, as illustrated in FIG. 31, correlated to the toner coat amount on the developing roller 31, and by detecting the reflection density, the toner coat amount on the developing roller 31 can be measured. FIG. 31 is a graph illustrating a relationship between the reflection density and the amount of toner coated on the developing roller. In the present exemplary embodiment, the toner coat amount is estimated by the detected reflection density, and by adjusting the toner coating area V in accordance with the toner coat amount, the toner coat amount is adjusted to the desired amount. In the present exemplary embodiment, the desired applied amount is 0.36 mg/cm^2 however, not limited to the above amount, the amount is appropriately set in accordance with, for example, the material of the toner and the configuration of the drive. Tables 5 and 6 below are experimental results in which the toner coat amount before passing through the developing blade had been measured in a case in which the stop position of the toner conveying member was changed in accordance with the detected reflection density and in a case in which the stop position of the toner conveying member was not changed.

Eighth Exemplary Embodiment

TABLE 5

| DETECTED REFLECTION DENSITY | 1.1 | 1.4 | 1.7 |
|---|---|---|---|
| DEVELOPING ROLLER COATED AMOUNT_mg/cm$^2$ | 0.36 | 0.36 | 0.36 |
| STOP POSITION OF TONER CONVEYING MEMBER | FIG. 26A | FIG. 26B | FIG. 26C |

* Stop position

FIG. 26A: A position where the tip of the toner conveying member is 10° downstream in the rotation direction with respect to the position in FIG. 26B FIG. 26B: A position where the tip of the toner conveying member is proximate to the developing roller FIG. 26C: A position where the tip of the toner conveying member is 10° upstream in the rotation direction with respect to the position in FIG. 26B

THIRD COMPARATIVE EXAMPLE

TABLE 6

| DETECTED REFLECTION DENSITY | 1.1 | 1.4 | 1.7 |
|---|---|---|---|
| DEVELOPING ROLLER COATED AMOUNT_mg/cm$^2$ | 0.22 | 0.36 | 0.49 |
| STOP POSITION OF TONER CONVEYING MEMBER | FIG. 26B | FIG. 26B | FIG. 26B |

As described above, by controlling the stop position of the toner conveying member 33 according to the detection result of the toner coated state detecting member, it will be possible to correct the coat amount to the desired toner coat when there is a change in the toner coat amount.

In the present exemplary embodiment, turning on of the image forming apparatus serves as a trigger to execute the present control; however, a detection of the change in the temperature or the humidity detected by the environment sensor, for example, may be the trigger to execute the present control.

Since the present control performs correction after detecting the actual state of the toner coated on the developing roller, in a case in which excessive toner is coated, an adverse effect such as generation of a fog, which is caused by supplying toner to a portion where no image is normally formed, may disadvantageously occur. When developing a solid image on the photosensitive drum, toner may become adhered to portions where no image is normally formed, and a problem such as consuming toner in a wasteful manner may occur. Accordingly, it is desirable that the control is executed in combination with the configuration of the sixth exemplary embodiment. By so doing, rough tuning may be performed through the control of the environment sensor having the configuration of the sixth exemplary embodiment, and fine tuning may be performed with the control in the eighth exemplary embodiment in which the toner coat amount is measured. With the above, the toner coat amount may be corrected to a desired amount in a precise manner without causing any defects.

The configurations of the exemplary embodiments described above may be combined in any possible way.

The present disclosure is capable of stabilizing the adhesion amount of toner, serving as a developer, on the developing roller, serving as a developer carrying member.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-080140 filed Apr. 13, 2016 and No. 2016-080518 filed Apr. 13, 2016, which are hereby incorporated by reference herein in their entirety.

What is claimed is:

1. A developing apparatus comprising:

a developer container that accommodates a developer;

a developer carrying member that is rotatably supported by the developer container, and that carries the developer on a surface thereof;

a conveying member that is provided inside the developer container and that conveys the developer, the conveying member including a shaft portion and a conveying portion connected to the shaft portion; and a restriction portion that restricts the developer carried on the developer carrying member, the restriction portion being disposed so as to oppose the developer carrying member in an area around the developer carrying member, the area corresponds to a side of the developer carrying member on which the surface of the developer carrying member moves gravitationally upwards during an image-forming period, wherein the conveying member is configured to move during a non-image-forming period, and stops at a stop position during the image-forming period, and wherein, when the conveying member stops at the stop position, a straight line, drawn from a base end of the conveying portion where the conveying portion connects to the shaft portion towards a tip of the conveying portion, intersects a surface of the developer carrying member opposing the inside of the developer container at a portion upstream in a rotation direction of the developer carrying member with respect to the restriction portion.

2. The developing apparatus according to claim 1, wherein when the conveying member stops at the stop position, a carrying amount of the developer carried on the developer carrying member is larger than a carrying amount while the conveying member stops at a position that is different from the stop position.

3. The developing apparatus according to claim 1, wherein when the conveying member stops at the stop position, in a case in which the straight line drawn from the tip to the base end extends gravitationally downwards, an angle formed between the straight line drawn from the tip to the base end and a horizontal line is smaller than an angle of repose of the developer.

4. The developing apparatus according to claim 1, wherein when the conveying member stops at the stop position, in a case in which the straight line drawn from the tip to the base end extends gravitationally upwards, an angle formed between the straight line drawn from the tip to the base end and a horizontal line is larger than an angle of repose of the developer.

5. The developing apparatus according to claim 1, wherein when the conveying member stops at the stop position, the tip is positioned between a tangential line extending gravitationally downwards, the tangential line being a tangential line among tangential lines that are drawn from a center of the shaft portion towards the surface of the developer carrying member, and a straight line drawn towards an end portion on an upstream side with respect to the restriction portion in a rotation direction of the developer carrying member from the center of the shaft portion.

6. The developing apparatus according to claim 1, wherein during the image-forming period, a center of the shaft portion and the restriction portion are disposed in the area around the developer carrying member and the area is gravitationally above a horizontal line passing through a rotation center of the developer carrying member.

7. The developing apparatus according to claim 1, wherein a center of the shaft portion during the image-forming period is disposed gravitationally below the restriction portion.

8. The developing apparatus according to claim 1, wherein in the developer carrying member, the surface on which the developer is carried includes a plurality of dielectric portions scattered on a surface formed of a conductive portion.

9. An image forming apparatus, comprising:

a developing apparatus including, a developer container that accommodates a developer;

a developer carrying member that is rotatably supported by the developer container, and that carries the developer on a surface thereof;

a conveying member that is provided inside the developer container and that conveys the developer, the conveying member including a shaft portion and a conveying portion connected to the shaft portion; and a restriction portion that restricts the developer carried on the developer carrying member, the restriction portion being disposed so as to oppose the developer carrying member in an area around the developer carrying member, the area corresponds to a side of the developer carrying member on which the surface of the developer carrying member moves gravitationally upwards during an image-forming period, wherein the conveying member is configured to move during a non-image-forming period, and stops at a stop position during the image-forming period, and wherein, when the conveying member stops at the stop position, a straight line, drawn from a base end of the conveying portion where the conveying portion connects to the shaft portion towards a tip of the conveying portion, intersects a surface of the developer carrying member opposing the inside of the developer container at a portion upstream in a rotation direction of the developer carrying member with respect to the restriction portion; and a control unit that performs control such that the conveying member stops at the stop position.

10. The image forming apparatus according to claim 9, wherein in a case in which formation of images is continuously performed on a plurality of recording mediums, the conveying member is moved from when an image to be transferred to a preceding recording medium is completed, for a preceding image formation, until when an image to be transferred to a succeeding recording medium starts, for a succeeding image formation.

11. A developing apparatus used in an image forming apparatus, comprising:

a frame body that accommodates developer;

a developer carrying member rotatably disposed in an accommodating chamber of the developer, the developer carrying member carrying the developer;

a first member that is disposed so as to abut against or be positioned close to a surface of the developer carrying member at a portion above a rotating shaft of the developer carrying member; and a second member that is disposed so as to be positioned close to the surface of the developer carrying member at a position upstream of the first member in a rotation direction of the developer carrying member and below the first member, wherein a distance in the rotation direction between a first position where the first member abuts against or is proximate to the surface of the developer carrying member, and a second position where the second member is proximate to the surface of the developer carrying member can be changed, wherein while the developing apparatus is performing an image forming operation, the distance is maintained, and wherein the second member is provided inside the accommodating chamber in a rotatable manner such that the second position changes in the rotation direction, and includes at least a first phase in which the distance becomes a first distance, and a second phase in which the distance becomes a second distance that is smaller than the first distance.

12. The developing apparatus according to claim 11, wherein the first member and the second member are disposed so as to oppose each other in the rotation direction such that the developer that had not been capable of moving over the first position even with the rotation of the developer carrying member is retained in a space that opposes an area of the surface of the developer carrying member between the first position and the second position.

13. The developing apparatus according to claim 11, wherein the second member includes a third phase in which the distance becomes a third distance that is larger than the first distance.

14. The developing apparatus according to claim 11, wherein the second member includes a shaft portion that rotates, and a sheet-like portion that extends from the shaft portion towards the second position, and wherein upon rotation of the shaft portion, an angle of a surface of the sheet-like portion that extends from the shaft portion towards the second portion changes and the distance is changed.

15. The developing apparatus according to claim 11, wherein the second member is a conveying member rotatably provided in the accommodating chamber so as to move the developer towards the developer carrying member, and the rotation thereof is stopped while the developing apparatus is performing an image forming operation.

16. The developing apparatus according to claim 11, wherein the second member includes a first restriction portion that, when in the first phase, is close to the developer carrying member at the second position that forms a first distance, and a second restriction portion that, when in the second phase, is close to the developer carrying member at the second position that forms the second distance.

17. The developing apparatus according to claim 11, wherein the second member includes an inclined surface that extends downwards towards the second position from a position above the second position and away from the developer carrying member, and is provided so as to be movable inside the accommodating chamber so that the second position changes in the rotation direction.

18. The developing apparatus according to claim 11, wherein the second member includes a shaft portion disposed close to the surface of the developer carrying member, and a sheet-like portion that extends upwards from the shaft portion, the second member including a first phase in which the second position becomes a position that is close to the shaft portion and a second phase in which the second position becomes a position that is close to the sheet-like portion.

19. The developing apparatus according to claim 11, wherein the first member is a restriction member that restricts an amount of developer carried on the developer carrying member.

20. The developing apparatus according to claim 11, wherein in the developer carrying member, a surface on which the developer is carried includes a plurality of dielectric portions scattered on a surface formed of a conductive portion.

21. A developing apparatus used in an image forming apparatus, comprising:

a frame body that accommodates developer;

a developer carrying member rotatably disposed in an accommodating chamber of the developer, the developer carrying member carrying the developer;

a first restriction member that is disposed so as to abut against a surface of the developer carrying member at a portion above a rotating shaft of the developer carrying member; and a second restriction member that, at a position upstream with respect to the first restriction member in a rotation direction of the developer carrying member and at a position below the first restriction member, includes a first end portion that approaches the surface of the developer carrying member, and a second end portion that is away from the surface, wherein, when viewed in a direction in which the rotating shaft of the developer carrying member extends, a distance between a point of contact between the surface and the first restriction member, and an intersection between an extended virtual line connecting the first end portion and the second end portion of the second restriction member and the surface is capable of being changed, and the distance is maintained while the developing apparatus is performing an image forming operation.

22. An image forming apparatus that forms an image on a recording material, comprising:

an image carrying member;

a developing apparatus used in an image forming apparatus including, a frame body that accommodates developer;

a developer carrying member rotatably disposed in an accommodating chamber of the developer, the developer carrying member carrying the developer;

a first member that is disposed so as to abut against or be positioned close to a surface of the developer carrying member at a portion above a rotating shaft of the developer carrying member; and a second member that is disposed so as to be positioned close to the surface of the developer carrying member at a position upstream of the first member in a rotation direction of the developer carrying member and below the first member, wherein a distance in the rotation direction between a first position where the first member abuts against or is proximate to the surface of the developer carrying member, and a second position where the second member is proximate to the surface of the developer carrying member can be changed, wherein while the developing apparatus is performing an image forming operation, the distance is maintained, wherein the first member and the second member are disposed so as to oppose each other in the rotation direction such that the developer that had not been capable of moving over the first position even with the rotation of the developer carrying member is retained in a space that opposes an area of the front surface of the developer carrying member between the first position and the second position; and wherein the second member is provided inside the accommodating chamber in a rotatable manner such that the second position changes in the rotation direction, and includes at least a first phase in which the distance becomes a first distance, and a second phase in which the distance becomes a second distance that is smaller than the first distance, and at least a control unit that controls the developing apparatus.

23. The image forming apparatus according to claim 22, further comprising:

a detection member that detects a temperature and a humidity, wherein the control unit controls the developing apparatus so that the distance is the first distance in a case in which the absolute moisture content acquired by the temperature and humidity detected by the detection member is higher or equivalent to a predetermined threshold, and controls the developing apparatus so that the distance is the second distance that is smaller than the first distance in a case in which the absolute moisture content is under a predetermined threshold.

24. The image forming apparatus according to claim 23, wherein the control unit sets the predetermined threshold as a first threshold, wherein in a case in which the absolute moisture content is equivalent to or higher than a first threshold and is equivalent to or lower than a second threshold that is higher than the first threshold, the control unit controls the developing apparatus so that the distance is the first distance, and wherein in a case in which the absolute moisture content is higher than the second threshold, the controller controls the developing apparatus so that the distance is a third distance that is larger than the first distance.

25. The image forming apparatus according to claim 22, further comprising:

a counter that counts a number of times in which an image formation has been performed, wherein the control unit controls the developing apparatus so that the distance is the first distance in a case in which the count number of the counter is smaller than a predetermined threshold, and controls the developing apparatus so that the distance is a third distance that is larger than the first distance in a case in which the count number is equivalent to or larger than the predetermined threshold.

26. The image forming apparatus according to claim 22, further comprising:

a detection member that detects an applied amount of developer per unit area carried by the developer carrying member, wherein the control unit controls the developing apparatus to change the distance so that the applied amount detected by the detection member becomes a predetermined applied amount.

27. The image forming apparatus according to claim 26, wherein the detection member includes a concentration detecting sensor that detects a reflection density of the developer image carried on the image carrying member, and detects the applied amount on the basis of the reflection density detected by the concentration detecting sensor.

* * * * *